US009249997B2

(12) United States Patent
Fujimoto et al.

(10) Patent No.: US 9,249,997 B2
(45) Date of Patent: Feb. 2, 2016

(54) REFRIGERATION APPARATUS HAVING AN INTERCOOLER DISPOSED BETWEEN FIRST AND SECOND STAGES OF A COMPRESSION MECHANISM AND AN INTERCOOLER BYPASS TUBE TO BYPASS THE INTERCOOLER

(75) Inventors: Shuji Fujimoto, Sakai (JP); Atsushi Yoshimi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 816 days.

(21) Appl. No.: 12/918,875

(22) PCT Filed: Feb. 25, 2009

(86) PCT No.: PCT/JP2009/053318

§ 371 (c)(1),
(2), (4) Date: Aug. 23, 2010

(87) PCT Pub. No.: WO2009/107617

PCT Pub. Date: Sep. 3, 2009

(65) Prior Publication Data

US 2011/0000246 A1 Jan. 6, 2011

(30) Foreign Application Priority Data

Feb. 29, 2008 (JP) ..... 2008-048903

(51) Int. Cl.
*F25B 13/00* (2006.01)
*F25B 1/10* (2006.01)
*F25B 1/00* (2006.01)

(52) U.S. Cl.
CPC ... *F25B 1/10* (2013.01); *F25B 1/00* (2013.01); *F25B 13/00* (2013.01);
(Continued)

(58) Field of Classification Search
CPC ..... F25B 13/00; F25B 1/00; F25B 41/00; F25B 2400/04
USPC ..... 62/324.6, 510, 512, 513, 498, 196.2, 62/324.2
See application file for complete search history.

(56) References Cited

U.S. PATENT DOCUMENTS

2004/0040339 A1 3/2004 Matsumoto et al.
2004/0089015 A1* 5/2004 Knight et al. ..... 62/324.1
(Continued)

FOREIGN PATENT DOCUMENTS

DE 103 13 850 A1 10/2004
JP 2004-116957 A 4/2004
(Continued)

OTHER PUBLICATIONS

International Preliminary Report of corresponding PCT Application No. PCT/JP2009/053318.
(Continued)

*Primary Examiner* — Cheryl J Tyler
*Assistant Examiner* — Harry Arant
(74) *Attorney, Agent, or Firm* — Global IP Counselors

(57) ABSTRACT

A refrigeration apparatus includes a compression mechanism, a heat source-side heat exchanger, a usage-side heat exchanger, an intercooler, an intercooler bypass tube and an intake return tube. The compression mechanism has a plurality of compression elements configured so that refrigerant discharged from a first-stage compression element is sequentially compressed by a second-stage compression element. The intercooler is connected to an intermediate refrigerant tube configured to draw refrigerant discharged from the first-stage compression element into the second-stage compression element to cool the refrigerant discharged from the first-stage compression element and drawn into the second-stage compression element. The intercooler bypass tube is connected to the intermediate refrigerant tube so as to bypass the intercooler. The intake return tube is configured to connect the intercooler and an intake side of the compression mechanism when the refrigerant discharged from the first-stage compression element is drawn into the second-stage compression element through the intercooler bypass tube.

4 Claims, 17 Drawing Sheets

(52) U.S. Cl.
CPC .. *F25B 2309/061* (2013.01); *F25B 2313/0272* (2013.01); *F25B 2313/02741* (2013.01); *F25B 2400/04* (2013.01); *F25B 2400/072* (2013.01); *F25B 2400/075* (2013.01); *F25B 2400/13* (2013.01)

(56) References Cited

U.S. PATENT DOCUMENTS

| | | | |
|---|---|---|---|
| 2005/0072173 | A1 | 4/2005 | Yamasaki et al. |
| 2005/0144964 | A1 | 7/2005 | Matsumoto et al. |
| 2005/0144972 | A1 | 7/2005 | Matsumoto et al. |
| 2005/0144973 | A1 | 7/2005 | Matsumoto et al. |
| 2005/0144977 | A1 | 7/2005 | Matsumoto et al. |
| 2005/0172661 | A1 | 8/2005 | Matsumoto et al. |
| 2005/0172662 | A1 | 8/2005 | Matsumoto et al. |
| 2005/0183447 | A1 | 8/2005 | Matsumoto et al. |
| 2009/0044564 | A1 | 2/2009 | Okamoto |

FOREIGN PATENT DOCUMENTS

| | | | | | |
|---|---|---|---|---|---|
| JP | 2004-301453 | A | | 10/2004 | |
| JP | 2005-003239 | A | | 1/2005 | |
| JP | 2007-115096 | A | | 5/2007 | |
| JP | 2007-183044 | | * | 7/2007 | ..... F25B 1/10 |
| JP | 2007-183044 | A | * | 7/2007 | |
| JP | 2007-183044 | A | | 7/2007 | |
| JP | 2007-232263 | A | | 9/2007 | |

OTHER PUBLICATIONS

International Search Report of corresponding PCT Application No. PCT/JP2009/053318.

The extended European search report for the corresponding European application No. 09715946.1, issued on Nov. 2, 2015.

* cited by examiner

REFRIGERATION APPARATUS HAVING AN INTERCOOLER DISPOSED BETWEEN FIRST AND SECOND STAGES OF A COMPRESSION MECHANISM AND AN INTERCOOLER BYPASS TUBE TO BYPASS THE INTERCOOLER

CROSS-REFERENCE TO RELATED APPLICATIONS

This U.S. National stage application claims priority under 35 U.S.C. §119(a) to Japanese Patent Application No. 2008-048903, filed in Japan on Feb. 29, 2008, the entire contents of which are hereby incorporated herein by reference.

TECHNICAL FIELD

The present invention relates to a refrigeration apparatus, and particularly relates to a refrigeration apparatus which performs a multistage compression refrigeration cycle.

BACKGROUND ART

As one conventional example of a refrigeration apparatus which performs a multistage compression refrigeration cycle, Japanese Laid-open Patent Publication No. 2007-232263discloses an air-conditioning apparatus which performs a two-stage compression refrigeration cycle. This air-conditioning apparatus primarily has a compressor having two compression elements connected in series, an outdoor heat exchanger, and an indoor heat exchanger.

SUMMARY

A refrigeration apparatus according to a first aspect of the present invention comprises a compression mechanism, a heat source-side heat exchanger, a usage-side heat exchanger, an intercooler, an intercooler bypass tube, and an intake return tube. The compression mechanism has a plurality of compression elements and is configured so that the refrigerant discharged from a first-stage compression element, which is one of the plurality of compression elements, is sequentially compressed by a second-stage compression element. As used herein, the term "compression mechanism" refers to a compressor in which a plurality of compression elements are integrally incorporated, or a configuration wherein includes a compression mechanism in which a single compression element is incorporated and/or a plurality of compression mechanisms in which a plurality of compression elements have been incorporated are connected together. The phrase "the refrigerant discharged from the first-stage compression element, which is one of the plurality of compression elements, is sequentially compressed by the second-stage compression element" does not mean merely that two compression elements connected in series are included, namely, the "first-stage compression element" and the "second-stage compression element;" but means that a plurality of compression elements are connected in series and the relationship between the compression elements is the same as the relationship between the aforementioned "first-stage compression element" and "second-stage compression element." The intercooler is provided to an intermediate refrigerant tube for drawing refrigerant discharged from the first-stage compression element into the second-stage compression element, and the intercooler functions as a cooler of the refrigerant discharged from the first-stage compression element and drawn into the second-stage compression element. The intercooler bypass tube is connected to the intermediate refrigerant tube so as to bypass the intercooler. The intake return tube is a refrigerant tube for connecting the intercooler and the intake side of the compression mechanism during a state in which the refrigerant discharged from the first-stage compression element is drawn into the second-stage compression element through the intercooler bypass tube.

In the conventional air conditioning apparatus, since the refrigerant discharged from the first-stage compression element of the compressor is drawn into the second-stage compression element of the compressor and further compressed, the temperature of the refrigerant discharged from the second-stage compression element of the compressor increases, and in the outdoor heat exchanger that functions as a radiator for the refrigerant, for example, there is a large difference in temperature between the refrigerant and the air and/or water used as the heat source, and increased heat radiation loss in the outdoor heat exchanger reduces the operating efficiency.

As a countermeasure to such problems, the intercooler which functions as a cooler of the refrigerant discharged from the first-stage compression element and drawn into the second-stage compression element is provided to the intermediate refrigerant tube for drawing refrigerant discharged from the first-stage compression element into the second-stage compression element, thereby lowering the temperature of the refrigerant drawn into the second-stage compression element. As a result, it is possible to reduce the temperature of the refrigerant discharged from the second-stage compression element, and heat radiation loss in the outdoor heat exchanger can be reduced.

However, there is a risk of liquid refrigerant accumulating in this intercooler at such times as when the refrigeration apparatus is stopped, and when operation is started in a state in which liquid refrigerant has accumulated in the intercooler, since the liquid refrigerant accumulated in the intercooler is drawn into the second-stage compression element, liquid compression occurs in the second-stage compression element, and the reliability of the compressor is reduced.

Therefore, in the refrigeration apparatus of the present invention, the intercooler bypass tube causes the refrigerant discharged from the first-stage compression element to flow so as to be drawn into the second-stage compression element without passing through the intercooler, the intercooler and the intake side of the compression mechanism are connected by the intake return tube, and the pressure of the refrigerant in the intercooler is reduced to a value near the low pressure of the refrigeration cycle so that the refrigerant in the intercooler can be drawn out to the intake side of the compression mechanism. Therefore, at such times as when the refrigeration apparatus is stopped, even when liquid refrigerant has accumulated inside the intercooler, the liquid refrigerant accumulated in the intercooler can be drawn out to the outside of the intercooler without being drawn into the second-stage compression element. When the refrigeration apparatus is operated in a state in which the intercooler bypass tube causes the refrigerant discharged from the first-stage compression element to be drawn into the second-stage compression element without passing through the intercooler, connecting the intercooler and the intake side of the compression mechanism by using the intake return tube creates a state in which liquid refrigerant does not readily accumulate in the intercooler. Through this configuration, the liquid compression in the second-stage compression element that was caused by accumulation of liquid refrigerant in the intercooler does not occur in the refrigeration apparatus, and the reliability of the compression mechanism can be enhanced.

A refrigeration apparatus according to a second aspect of the present invention is the refrigeration apparatus according to the first aspect of the present invention, further comprising a switching mechanism for switching between a cooling operation state in which refrigerant is circulated in sequence through the compression mechanism, the heat source-side heat exchanger, and the usage-side heat exchanger, and a heating operation state in which refrigerant is circulated in sequence through the compression mechanism, the usage-side heat exchanger, and the heat source-side heat exchanger; wherein the refrigerant discharged from the first-stage compression element is drawn into the second-stage compression element through the intercooler bypass tube, and the intercooler and the intake side of the compression mechanism are connected via the intake return tube at the start of operation in which the switching mechanism is in the cooling operation state.

This refrigeration apparatus is configured so that the refrigerant discharged from the first-stage compression element is drawn into the second-stage compression element through the intercooler bypass tube, and the intercooler and the intake side of the compression mechanism are connected via the intake return tube at the start of operation in which the switching mechanism is in the cooling operation state. Therefore, even when liquid refrigerant is accumulated in the intercooler prior to the start of operation in which the switching mechanism is in the cooling operation state, the liquid refrigerant can be drawn out to the outside of the intercooler. It is thereby possible to prevent a state in which liquid refrigerant is accumulated in the intercooler at the start of operation in which the switching mechanism is in the cooling operation state, and the refrigerant discharged from the first-stage compression element can be drawn into the second-stage compression element via the intercooler without liquid compression occurring in the second-stage compression element due to accumulation of liquid refrigerant in the intercooler.

A refrigeration apparatus according to a third aspect of the present invention is the refrigeration apparatus according to the first or second aspect of the present invention, further comprising a switching mechanism for switching between a cooling operation state in which refrigerant is circulated in sequence through the compression mechanism, the heat source-side heat exchanger, and the usage-side heat exchanger, and a heating operation state in which refrigerant is circulated in sequence through the compression mechanism, the usage-side heat exchanger, and the heat source-side heat exchanger; wherein the refrigerant discharged from the first-stage compression element is drawn into the second-stage compression element through the intercooler bypass tube, and the intercooler and the intake side of the compression mechanism are connected via the intake return tube when the switching mechanism is in the heating operation state.

This refrigeration apparatus is configured so that the refrigerant discharged from the first-stage compression element is drawn into the second-stage compression element through the intercooler bypass tube, and the intercooler and the intake side of the compression mechanism are connected via the intake return tube when the switching mechanism is in the heating operation state. It is therefore possible to prevent heat radiation loss to the outside from the intercooler when the switching mechanism is in the heating operation state, and a state can be created in which liquid refrigerant does not readily accumulate in the intercooler. A reduction in heating performance in the usage-side heat exchanger can thereby be suppressed when the switching mechanism is in the heating operation state, liquid refrigerant can be prevented from accumulating in the intercooler at the start of operation in which the switching mechanism is in the cooling operation state, and the refrigerant discharged from the first-stage compression element can be drawn into the second-stage compression element via the intercooler without liquid compression occurring in the second-stage compression element due to accumulation of liquid refrigerant in the intercooler.

A refrigeration apparatus according to a fourth aspect of the present invention is the refrigeration apparatus according to any of the first through third aspects of the present invention, further comprising an intercooler switching valve capable of switching between a refrigerant non-return state wherein the refrigerant discharged from the first-stage compression element is drawn into the second-stage compression element via the intercooler, and the intercooler and the intake side of the compression mechanism are not connected via the intake return tube; and a refrigerant return state wherein the refrigerant discharged from the first-stage compression element is drawn into the second-stage compression element through the intercooler bypass tube, and the intercooler and the intake side of the compression mechanism are connected via the intake return tube.

In this refrigeration apparatus, since the intercooler switching valve is capable of switching between a refrigerant non-return state and a refrigerant return state, the number of valves can be reduced in comparison to a configuration in which a refrigerant non-return state and a refrigerant return state are switched by a plurality of valves.

DETAILED DESCRIPTION OF EMBODIMENT(S)

Embodiments of the refrigeration apparatus according to the present invention are described hereinbelow with reference to the drawings.

(1) Basic Configuration of Air-Conditioning Apparatus

Figure 1:
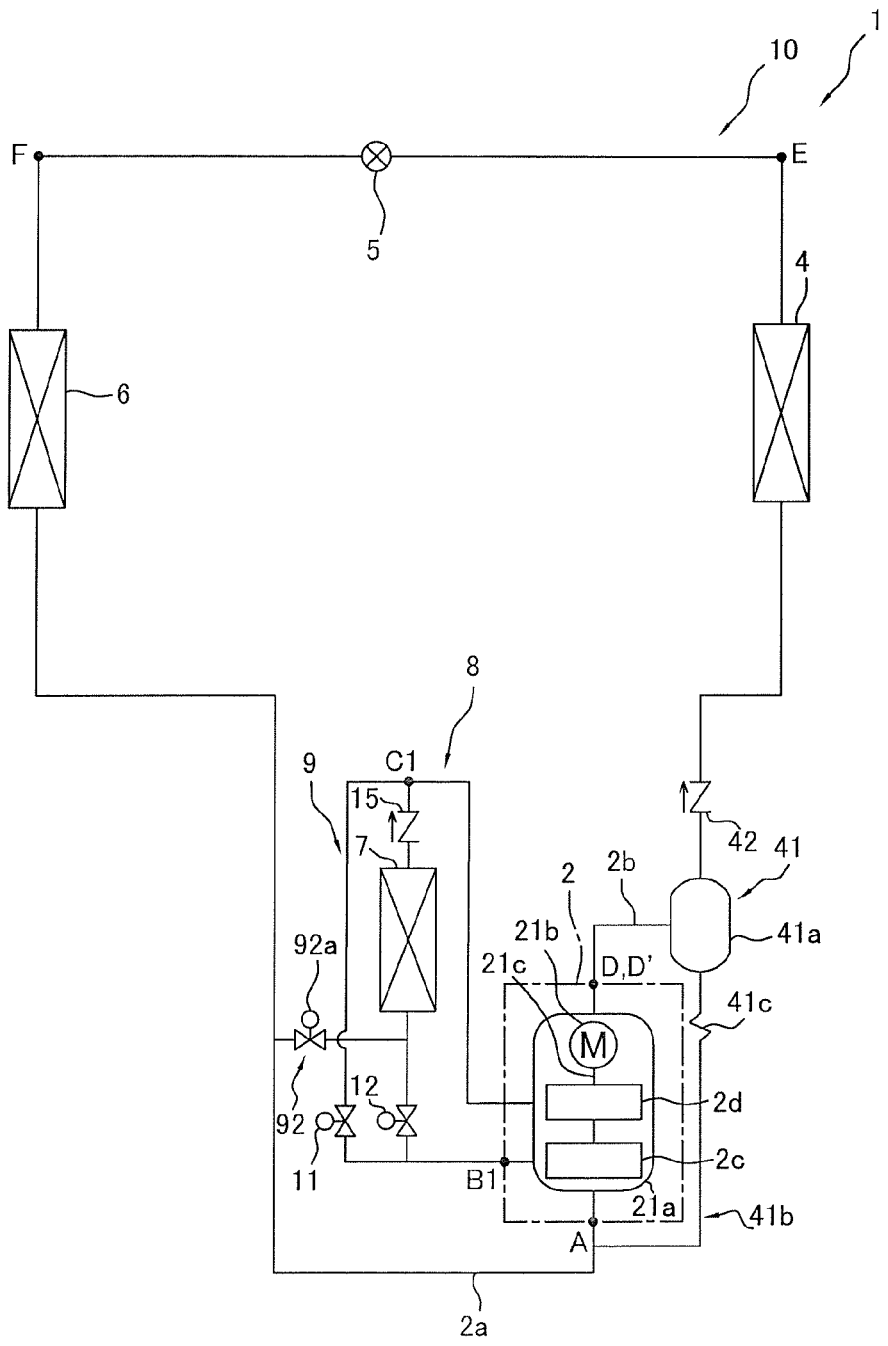
FIG. 1 is a schematic structural diagram of an air-conditioning apparatus as an embodiment of the refrigeration apparatus according to the present invention.

FIG. 1 is a schematic structural diagram of an air-conditioning apparatus 1 as an embodiment of the refrigeration apparatus according to the present invention. The air-conditioning apparatus 1 has a refrigerant circuit 10 configured so as to be capable of an air-cooling operation, and the apparatus performs a two-stage compression refrigeration cycle by using a refrigerant (carbon dioxide in this case) for operating in a supercritical range.

The refrigerant circuit 10 of the air-conditioning apparatus 1 has primarily a compression mechanism 2, a heat source-side heat exchanger 4, an expansion mechanism 5, a usage-side heat exchanger 6, and an intercooler 7.

In the present embodiment, the compression mechanism 2 is configured from a compressor 21 which uses two compression elements to subject a refrigerant to two-stage compression. The compressor 21 has a hermetic structure in which a compressor drive motor 21*b*, a drive shaft 21*c*, and compression elements 2*c*, 2*d* are housed within a casing 21*a*. The compressor drive motor 21*b* is linked to the drive shaft 21*c*. The drive shaft 21*c* is linked to the two compression elements 2*c*, 2*d*. Specifically, the compressor 21 has a so-called single-shaft, two-stage compression structure in which the two compression elements 2*c*, 2*d* are linked to the single drive shaft 21*c* and the two compression elements 2*c*, 2*d* are both rotatably driven by the compressor drive motor 21*b*. In the present embodiment, the compression elements 2*c*, 2*d* are rotary elements, scroll elements, or another type of positive displacement compression elements. The compressor 21 is configured so as to suck refrigerant through an intake tube 2*a*, to discharge this refrigerant to an intermediate refrigerant tube 8 after the refrigerant has been compressed by the compression element 2*c*, to suck the refrigerant discharged to the intermediate refrigerant tube 8 into the compression element 2*d*, and to discharge the refrigerant to a discharge tube 2*b* after the refrigerant has been further compressed. The intermediate refrigerant tube 8 is a refrigerant tube for taking refrigerant into the compression element 2*d* connected to the second-stage side of the compression element 2*c* after the refrigerant has been discharged at an intermediate pressure in the refrigeration cycle from the compression element 2*c* connected to the first-stage side of the compression element 2*d*. The discharge tube 2*b* is a refrigerant tube for feeding refrigerant discharged from the compression mechanism 2 to the heat source-side heat exchanger 4 as a radiator, and the discharge tube 2*b* is provided with an oil separation mechanism 41 and a non-return mechanism 42. The oil separation mechanism 41 is a mechanism for separating refrigerator oil accompanying the refrigerant from the refrigerant discharged from the compression mechanism 2 and returning the oil to the intake side of the compression mechanism 2, and the oil separation mechanism 41 has primarily an oil separator 41*a* for separating refrigerator oil accompanying the refrigerant from the refrigerant discharged from the compression mechanism 2, and an oil return tube 41*b* connected to the oil separator 41*a* for returning the refrigerator oil separated from the refrigerant to the intake tube 2*a* of the compression mechanism 2. The oil return tube 41*b* is provided with a pressure-reducing mechanism 41*c* for depressurizing the refrigerator oil flowing through the oil return tube 41*b*. A capillary tube is used for the pressure-reducing mechanism 41*c* in the present embodiment. The non-return mechanism 42 is a mechanism for allowing the flow of refrigerant from the discharge side of the compression mechanism 2 to the heat source-side heat exchanger 4 as a radiator and for blocking the flow of refrigerant from the heat source-side heat exchanger 4 as a radiator to the discharge side of the compression mechanism 2, and a non-return valve is used in the present embodiment.

Thus, in the present embodiment, the compression mechanism 2 has two compression elements 2*c*, 2*d* and is configured so that among these compression elements 2*c*, 2*d*, refrigerant discharged from the first-stage compression element is compressed in sequence by the second-stage compression element.

The heat source-side heat exchanger 4 is a heat exchanger that functions as a refrigerant radiator. One end of the heat source-side heat exchanger 4 is connected to the compression mechanism 2, and the other end is connected to the expansion mechanism 5. Though not shown in the drawings, the heat source-side heat exchanger 4 is supplied with water or air as a cooling source for conducting heat exchange with the refrigerant flowing through the heat source-side heat exchanger 4.

The expansion mechanism 5 is a mechanism for depressurizing the refrigerant sent to the usage-side heat exchanger 6 functioning as the evaporator from the heat source-side heat exchanger 4 functioning as the radiator, and an electrically driven expansion valve is used in the present embodiment. One end of the expansion mechanism 5 is connected to the heat source-side heat exchanger 4, and the other end is connected to the usage-side heat exchanger 6. In the present embodiment, the high-pressure refrigerant cooled in the heat source-side heat exchanger 4 is depressurized by the expansion mechanism 5 to a pressure near the low pressure of the refrigeration cycle before being sent to the usage-side heat exchanger 6 functioning as the evaporator.

The usage-side heat exchanger 6 is a heat exchanger that functions as an evaporator of refrigerant. One end of the usage-side heat exchanger 6 is connected to the expansion mechanism 5, and the other end is connected to the compression mechanism 2. Though not shown in the drawings, the usage-side heat exchanger 6 is supplied with water or air as a heating source for conducting heat exchange with the refrigerant flowing through the usage-side heat exchanger 6.

The intercooler 7 is provided to the intermediate refrigerant tube 8, and is a heat exchanger which functions as a cooler of refrigerant discharged from the compression element 2*c* on the first-stage side and drawn into the compression element 2*d*. Though not shown in the drawings, the intercooler 7 is supplied with water or air as a cooling source for conducting heat exchange with the refrigerant flowing through the intercooler 7. Thus, it is acceptable to say that the intercooler 7 is a cooler that uses an external heat source, meaning that the intercooler does not use the refrigerant that circulates through the refrigerant circuit 10.

An intercooler bypass tube 9 is connected to the intermediate refrigerant tube 8 so as to bypass the intercooler 7. This intercooler bypass tube 9 is a refrigerant tube for limiting the flow rate of refrigerant flowing through the intercooler 7. The intercooler bypass tube 9 is provided with an intercooler bypass on/off valve 11. The intercooler bypass on/off valve 11 is an electromagnetic valve in the present embodiment. Excluding cases in which temporary operations such as the hereinafter-described air-cooling start control are performed, in the present embodiment the intercooler bypass on/off valve 11 is essentially closed.

An intercooler on/off valve 12 is provided to the intermediate refrigerant tube 8 in the portion extending from the connection with the end of the intercooler bypass tube 9 on the side of the first-stage compression element 2*c* to the inlet of the intercooler 7. The intercooler on/off valve 12 is a mechanism for limiting the flow rate of refrigerant flowing through the intercooler 7. The intercooler on/off valve 12 is an electromagnetic valve in the present embodiment. Excluding cases in which temporary operations such as the hereinafter-described air-cooling start control are performed, in the present embodiment the intercooler on/off valve 12 is essentially opened.

The intermediate refrigerant tube 8 is also provided with a non-return mechanism 15 for allowing refrigerant to flow from the discharge side of the first-stage compression element 2*c* to the intake side of the second-stage compression element 2*d* and for blocking the refrigerant from flowing from the intake side of the second-stage compression element 2*d* to the discharge side of the first-stage compression element 2*c*. The non-return mechanism 15 is a non-return valve in the present embodiment. In the present embodiment, the non-return mechanism 15 is provided to the intermediate refrigerant tube 8 in the portion leading away from the outlet of the intercooler 7 toward the part connecting with the end of the intercooler bypass tube 9 toward the second stage compression element 2*d*.

A first intake return tube 92 is also connected to one end (the inlet in this case) of the intermediate refrigerant tube 8 or the intercooler 7. The first intake return tube 92 is a refrigerant tube for connecting the intercooler 7 and the intake side (the intake tube 2*a* in this case) of the compression mechanism 2 in a state in which the refrigerant discharged from the first-stage compression element 2*c* is drawn into the second-stage compression element 2*d* via the intercooler bypass tube 9. In the present embodiment, one end of the first intake return tube 92 is connected to the portion extending from the connection of the end of the intercooler bypass tube 9 of the intermediate refrigerant tube 8 on the side of the first-stage compression element 2*c* to the inlet of the intercooler 7, and the other end of the first intake return tube 92 is connected to the intake side (the intake tube 2*a* in this case) of the compression mechanism 2. A first intake return on/off valve 92*a* is provided to the first intake return tube 92. The first intake return on/off valve 92*a* is an electromagnetic valve in the present embodiment. Excluding cases in which temporary operations such as the hereinafter-described air-cooling start control are performed, in the present embodiment the first intake return on/off valve 92*a* is essentially closed.

Through not shown in the drawings, the air-conditioning apparatus 1 has a control unit for controlling the operation of the compression mechanism 2, the expansion mechanism 5, the intercooler bypass on/off valve 11, the intercooler on/off valve 12, the first intake return on/off valve 92*a*, and other components of the air-conditioning apparatus 1.

(2) Action of the Air-Conditioning Apparatus

Figure 2:
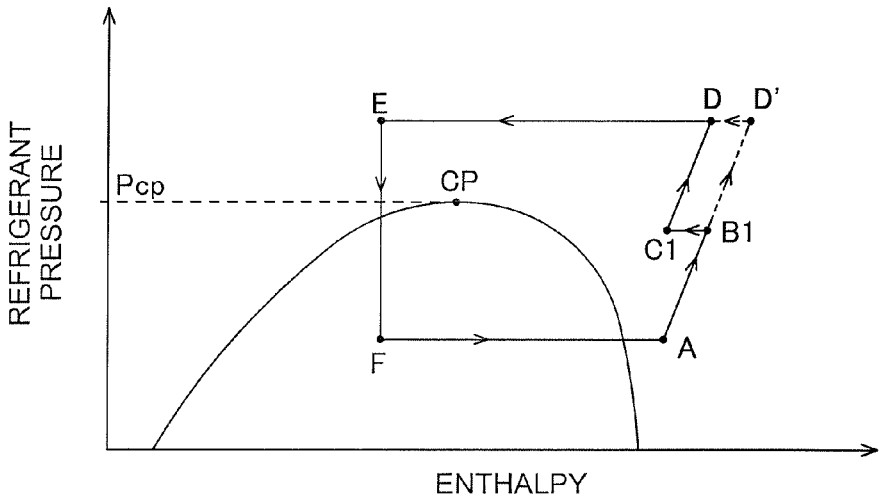
FIG. 2 is a pressure-enthalpy graph representing the refrigeration cycle during the air-cooling operation.
Figure 3:
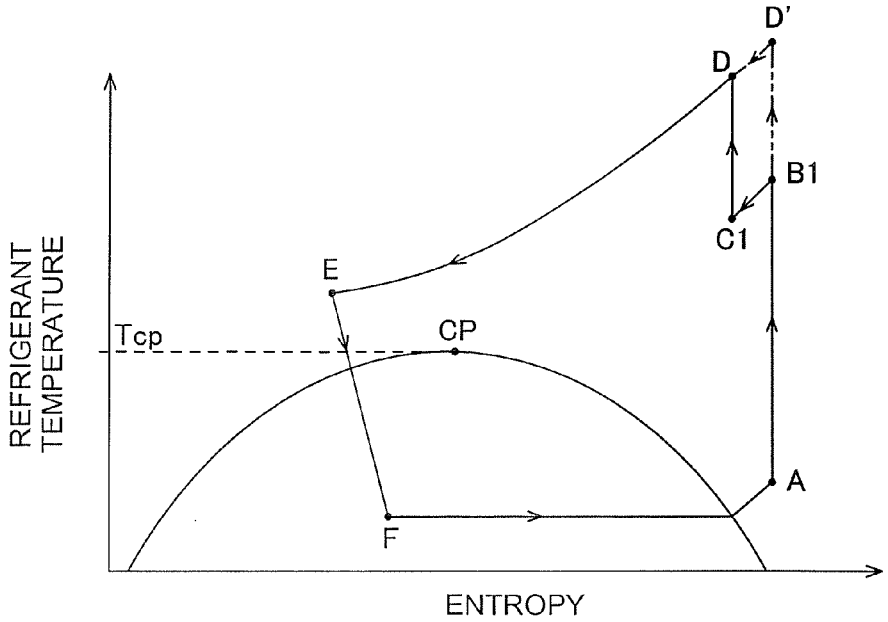
FIG. 3 is a temperature-entropy graph representing the refrigeration cycle during the air-cooling operation.
Figure 4:
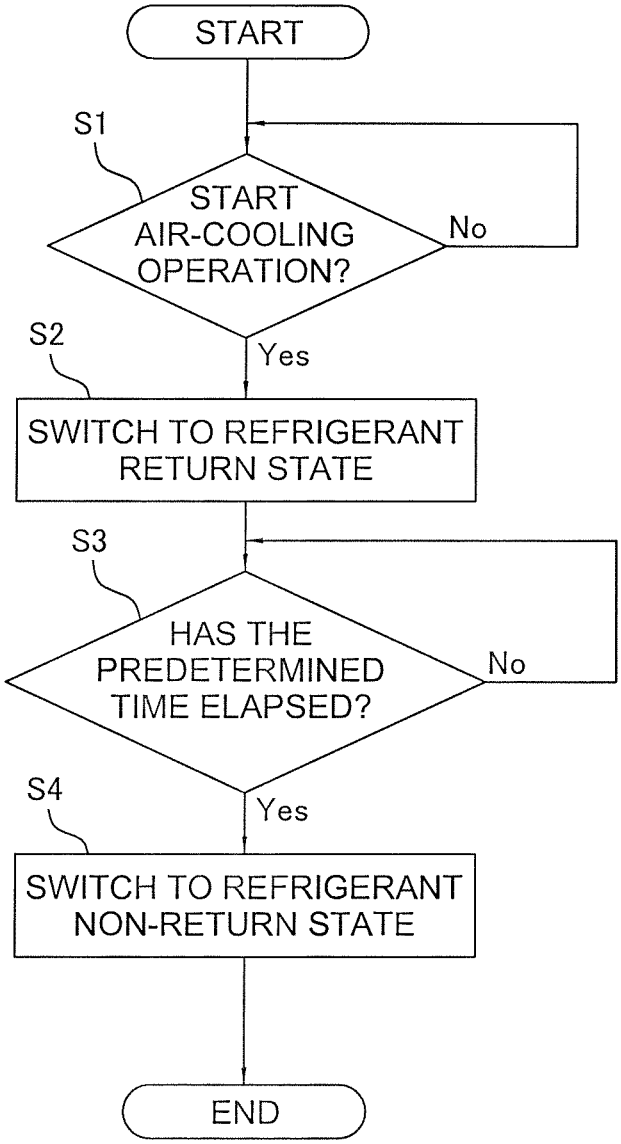
FIG. 4 is a flowchart of the air-cooling start control.
Figure 5:
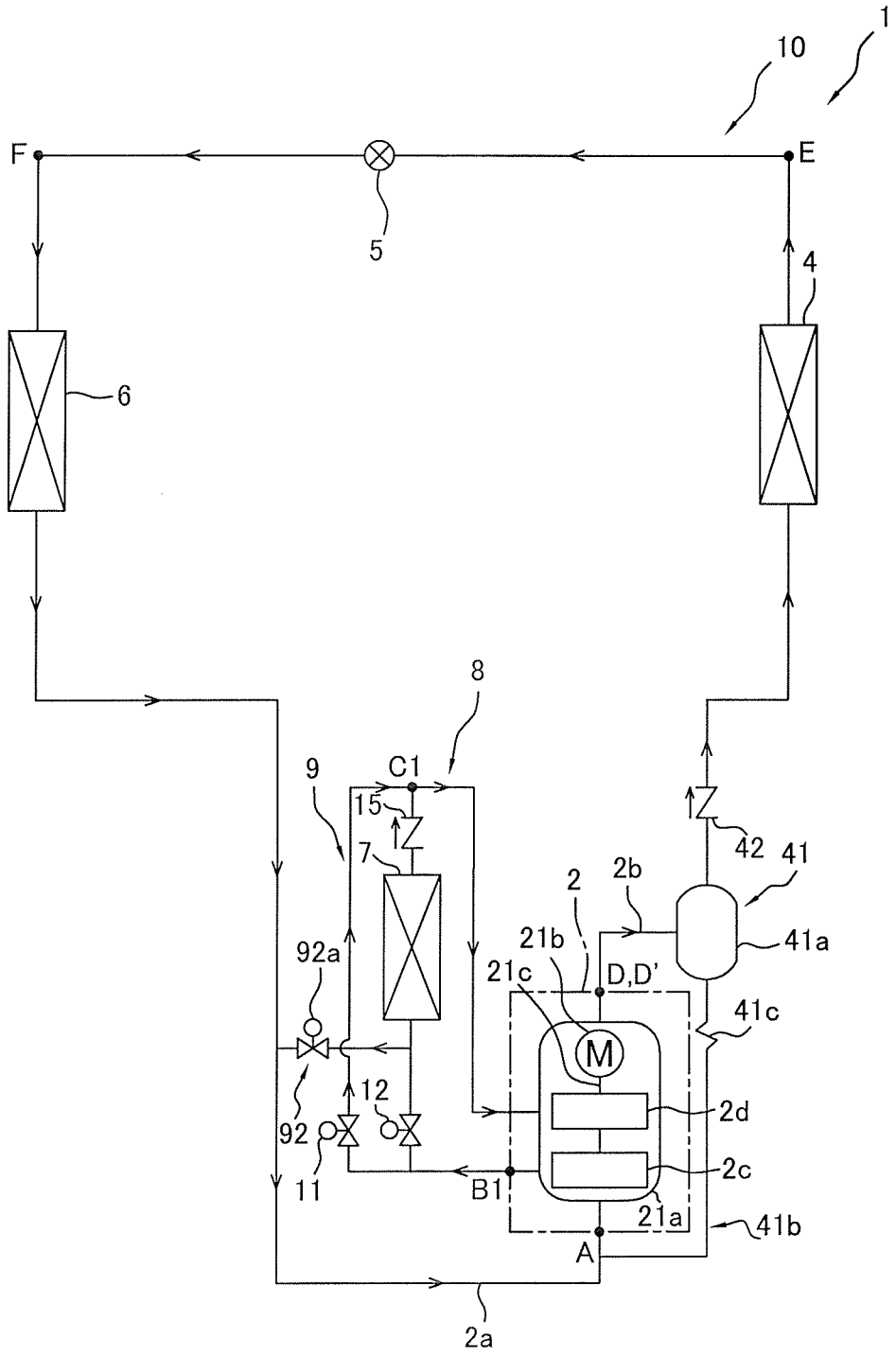
FIG. 5 is a diagram showing the flow of refrigerant within the air-conditioning apparatus during the air-cooling start control.

Next, the action of the air-conditioning apparatus 1 of the present embodiment will be described using FIGS. 1 through 5. FIG. 2 is a pressure-enthalpy graph representing the refrigeration cycle during the air-cooling operation, and FIG. 3 is a temperature-entropy graph representing the refrigeration cycle during the air-cooling operation. FIG. 4 is a flow chart of the air-cooling start control. FIG. 5 is a diagram showing the flow of refrigerant within the air-conditioning apparatus 1 during the air-cooling start control. Operation control and air-cooling start control during the following air-cooling operation are performed by the aforementioned controller (not shown). In the following description, the term "high pressure" means a high pressure in the refrigeration cycle (specifically, the pressure at points D, D', and E in FIGS. 2 and 3), the term "low pressure" means a low pressure in the refrigeration cycle (specifically, the pressure at points A and F in FIGS. 2 and 3), and the term "intermediate pressure" means an intermediate pressure in the refrigeration cycle (specifically, the pressure at points B1 and C1 in FIGS. 2 and 3).

<Air-Cooling Operation>

During air-cooling operation, the opening degree of the expansion mechanism 5 is adjusted. The intercooler on/off valve 12 of the intermediate refrigerant tube 8 is opened, and the intercooler bypass on/off valve 11 of the intercooler bypass tube 9 is closed, whereby the intercooler 7 is made to function as a cooler. The first intake return on/off valve 92*a* of the first intake return tube 92 is closed, thereby creating a state in which the intercooler 7 and the intake side of the compression mechanism 2 are not connected (except during the air-cooling start control described hereinafter).

When the refrigerant circuit 10 is in this state, low-pressure refrigerant (refer to point A in FIGS. 1 through 3) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 1 through 3). The intermediate-pressure refrigerant discharged from the first-stage compression element 2*c* is cooled by heat exchange with water or air as a cooling source in the intercooler 7 (refer to point C1 in FIGS. 1 to 3). The refrigerant cooled in the intercooler 7 is then led to and further compressed in the compression element 2*d* connected to the second-stage side of the compression element 2*c*, and the refrigerant is then discharged from the compression mechanism 2 to the discharge tube 2*b* (refer to point D in FIGS. 1 through 3). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 2). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and fed to the heat source-side heat exchanger 4 functioning as a refrigerant radiator. The high-pressure refrigerant fed to the heat source-side heat exchanger 4 is cooled in the heat source-side heat exchanger 4 by heat exchange with water or air as a cooling source (refer to point E in FIGS. 1 through 3). The high-pressure refrigerant cooled in the heat source-side heat exchanger 4 is then depressurized by the expansion mechanism 5 to become a low-pressure gas-liquid two-phase refrigerant, which is fed to the usage-side heat exchanger 6 functioning as a refrigerant evaporator (refer to point F in FIGS. 1 through 3). The low-pressure gas-liquid two-phase refrigerant fed to the usage-side heat exchanger 6 is heated by heat exchange with water or air as a heating source in the usage-side heat exchanger 6, and the refrigerant evaporates as a result (refer to point A in FIGS. 1 through 3). The low-pressure refrigerant heated in the usage-side heat exchanger 6 is then led back into the compression mechanism 2. In this manner the air-cooling operation is performed.

Thus, in the air-conditioning apparatus 1, the intercooler 7 is provided to the intermediate refrigerant tube 8 for letting refrigerant discharged from the compression element 2*c* into the compression element 2*d*, and the intercooler on/off valve 12 is opened and the intercooler bypass on/off valve 11 of the intercooler bypass tube 9 is closed during the air-cooling operation, thereby putting the intercooler 7 into a state of functioning as a cooler. Therefore, the refrigerant drawn into the compression element 2*d* on the second-stage side of the compression element 2*c* decreases in temperature (refer to points B1 and C1 in FIG. 3) and the refrigerant discharged from the compression element 2*d* also decreases in temperature (refer to points D and D' in FIG. 3), in comparison with cases in which no intercooler 7 is provided (in this case, the refrigeration cycle is performed in the sequence in FIGS. 2 and 3: point A→point B1→point D'→point E→point F). Therefore, in the heat source-side heat exchanger 4 functioning as a radiator of high-pressure refrigerant in this air-conditioning apparatus 1, operating efficiency can be improved over cases in which no intercooler 7 is provided, because the temperature difference between the refrigerant and water or air as the cooling source can be reduced, and heat radiation loss can be reduced by an amount equivalent to the area enclosed by connecting points B1, D', D, and C1 in FIG. 3.

<Air-Cooling Start Control>

In the intercooler 7 such as the one described above, there is a risk of accumulation of liquid refrigerant at such times as when the air-conditioning apparatus 1 is stopped, and when the air-cooling operation described above is started in a state in which liquid refrigerant has accumulated in the intercooler 7, since the liquid refrigerant accumulated in the intercooler 7 is drawn into the second-stage compression element 2*d*, liquid compression occurs in the second-stage compression element 2*d*, and the reliability of the compression mechanism 2 is reduced.

Therefore, in the present embodiment, air-cooling start control is performed so that the refrigerant discharged from the first-stage compression element 2*c* is drawn into the second-stage compression element 2*d* through the intercooler bypass tube 9, and the intercooler 7 and the intake side of the compression mechanism 2 are connected by the first intake return tube 92 at the start of the air-cooling operation described above.

The air-cooling start control of the present embodiment is described in detail hereinbelow using FIGS. 4 and 5.

First, when a command is issued in step S1 to start air-cooling operation, the process proceeds to step S2, in which the various valves are operated.

Then, in step S2, the on/off states of the on/off valves 11, 12, 92*a* are switched to the refrigerant return state in which the refrigerant discharged from the first-stage compression element 2*c* is drawn into the second stage compression element 2*d* via the intercooler bypass tube 9, and the intercooler 7 and the intake side of the compression mechanism 2 are connected via the first intake return tube 92. Specifically, the intercooler bypass on/off valve 11 is opened, and the intercooler on/off valve 12 is closed. The intercooler bypass tube 9 then causes a flow to occur whereby the refrigerant discharged from the first-stage compression element 2*c* is drawn into the second-stage compression element 2*d* without passing through the intercooler 7. Specifically, a state is effected in which the intercooler 7 does not function as a cooler, and the refrigerant discharged from the first-stage compression element 2*c* is drawn into the second-stage compression element 2*d* via the intercooler bypass tube 9 (see FIG. 5). In such a state, the first intake return on/off valve 92*a* is then opened. The intercooler 7 and the intake side of the compression mechanism 2 are then connected by the first intake return tube 92, and the pressure of the refrigerant in the intercooler 7 (more specifically, the portion between the intercooler on/off valve 12 and the non-return mechanism 15 that includes the intercooler 7) is reduced to near the low pressure of the refrigeration cycle so that the refrigerant in the intercooler 7 can be drawn out to the intake side of the compression mechanism 2 (see FIG. 5).

Then, in step S3, the on/off states of the on/off valves 11, 12, 92*a* in step S2 (i.e., the refrigerant return state) are maintained for a predetermined amount of time. The liquid refrigerant accumulated in the intercooler 7 can thereby be evaporated by depressurization, drawn out to the outside of the intercooler 7 (more specifically, to the intake side of the compression mechanism 2), and drawn into the compression mechanism 2 (here, the first-stage compression element 2*c*) without being drawn into the second-stage compression element 2*d*, even when liquid refrigerant has accumulated inside the intercooler 7 at such times as when the air conditioning apparatus 1 is stopped. The predetermined time herein is set to an amount of time sufficient for the liquid refrigerant accumulated in the intercooler 7 to be drawn out to the outside of the intercooler 7.

Then, in step S4, the on/off states of the on/off valves 11, 12, 92*a* are switched to the refrigerant non-return state in which the refrigerant discharged from the first-stage compression element 2*c* is drawn into the second-stage compression element 2*d* via the intercooler 7, and the intercooler 7 and the intake side of the compression mechanism 2 are not connected via the first intake return tube 92. Specifically, the process transitions to the on/off states of the valves 11, 12, 92*a* for the air-cooling operation described above, and air-cooling start control is completed. Specifically, the first intake return on/off valve 92*a* is closed. A state then arises in which the refrigerant in the intercooler 7 does not flow out to the intake side of the compression mechanism 2. In such a state, the intercooler on/off valve 12 is opened, and the intercooler bypass on/off valve 11 is closed. The intercooler 7 then functions as a cooler.

Through this configuration, the liquid compression in the second-stage compression element 2*d* that was caused by accumulation of liquid refrigerant in the intercooler 7 does not occur in the air-conditioning apparatus 1 at the start of air-cooling operation, and the reliability of the compression mechanism 2 can be enhanced.

(3) Modification 1

In the embodiment described above, switching between air-cooling operation and air-cooling start control, i.e., switching between the refrigerant non-return state and the refrigerant return state, is accomplished by the on/off states of the on/off valves 11, 12, 92*a*. However, a refrigerant circuit 110 may be used that is provided with an intercooler switching valve 93 capable of switching between a refrigerant non-return state and a refrigerant return state, instead of the on/off valves 11, 12, 92*a*, as shown in FIG. 6.

Here, the intercooler switching valve 93 is a valve capable of switching between a refrigerant non-return state and a refrigerant return state, and in the present modification, the intercooler switching valve 93 is a four-way switching valve connected to the intermediate refrigerant tube 8 at the discharge side of the first-stage compression element 2*c*, the intermediate refrigerant tube 8 at the inlet side of the intercooler 7, the end of the intercooler bypass tube 9 on the side of the first-stage compression element 2*c*, and the end of the first intake return tube 92 on the side of the intercooler 7. The intercooler bypass tube 9 is also provided with a non-return mechanism 9 for allowing refrigerant to flow from the discharge side of the first-stage compression element 2*c* to the intake side of the second-stage compression element 2*d* and for blocking the refrigerant from flowing from the intake side of the second-stage compression element 2*d* to the discharge side of the first-stage compression element 2*c* and the intake side of the compression mechanism 2. The non-return mechanism 9*a* is a non-return valve in the present modification.

Figure 6:
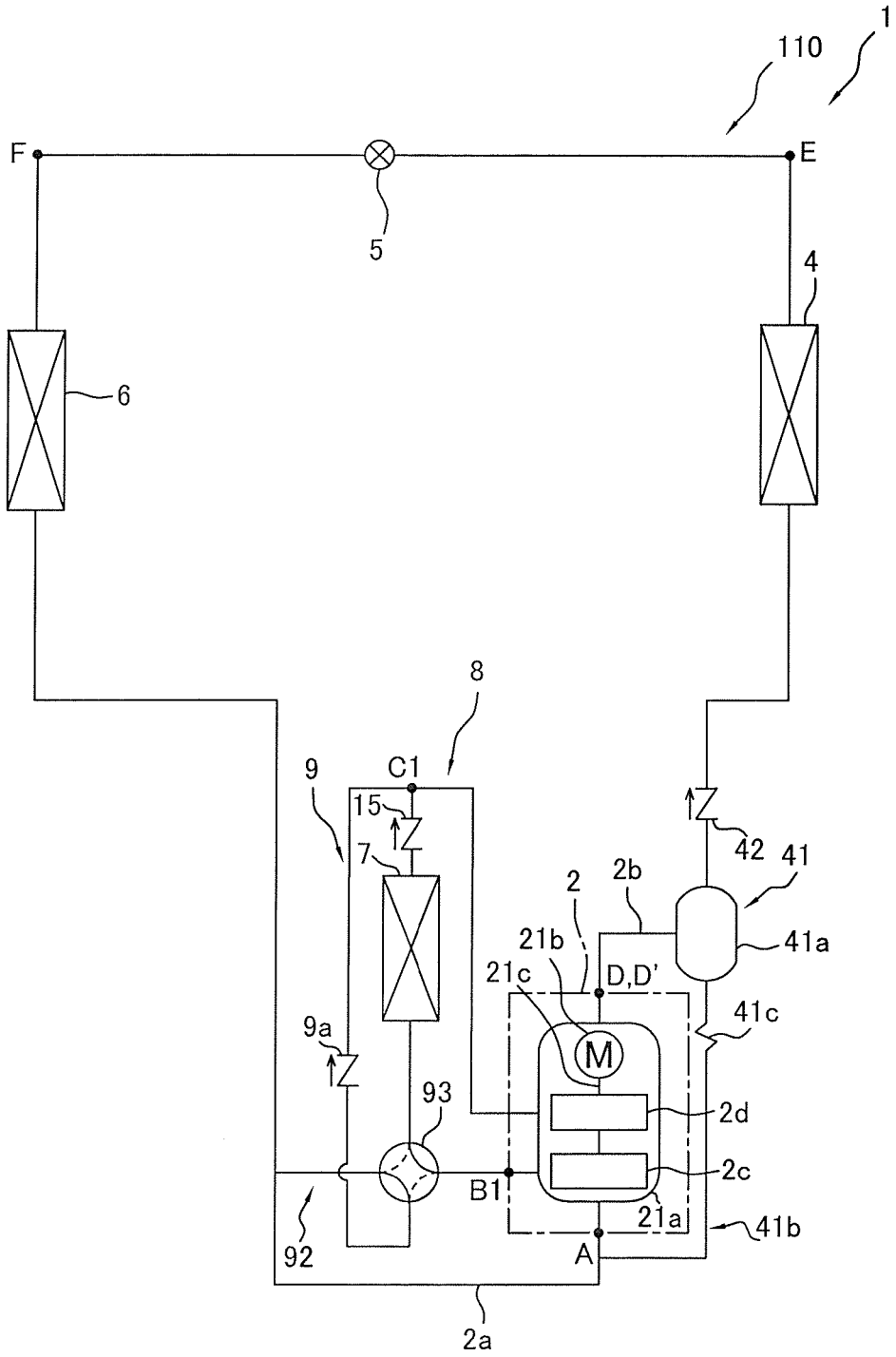
FIG. 6 is a schematic structural diagram of an air-conditioning apparatus according to Modification 1.

Although not described in detail in the present modification, by switching the intercooler switching valve 93 to the refrigerant non-return state (indicated by solid lines in the intercooler switching valve 93 shown in FIG. 6) in which the refrigerant discharged from the first-stage compression element 2*c* is drawn into the second-stage compression element 2*d* via the intercooler 7, and the intercooler 7 and the intake side of the compression mechanism 2 are not connected via the first intake return tube 92, the same air-cooling operation as that of the embodiment described above is performed. By switching the intercooler switching valve 93 to the refrigerant return state (indicated by dashed lines in the intercooler switching valve 93 shown in FIG. 6) in which the intercooler 7 and the intake side of the compression mechanism 2 are connected via the first intake return tube 92, and the refrigerant discharged from the first-stage compression element 2*c* is drawn into the second-stage compression element 2*d* via the intercooler bypass tube 9, the same air-cooling start control as described in the embodiment above can also be performed.

The same operational effects as those of the embodiment described above can also be achieved with the configuration of the present modification. In the present modification, since it is possible to switch between the refrigerant non-return state and the refrigerant return state by using the intercooler switching valve 93, the number of valves can be reduced in comparison to a configuration in which a refrigerant non-return state and a refrigerant return state are switched by the plurality of valves 11, 12, 92*a* as described in the above embodiment. Since pressure drop is also reduced relative to a case in which an electromagnetic valve is used, the intermediate pressure of the refrigeration cycle can be prevented from decreasing, and operating efficiency can be prevented from decreasing as well.

(4) Modification 2

In the embodiment and modification thereof described above, the air-conditioning apparatus 1 which performs a two-stage compression refrigeration cycle and is capable of air-cooling operation is provided with the intercooler 7 for functioning as a cooler for refrigerant discharged from the first-stage compression element 2*c* and drawn into the second-stage compression element 2*d*; the intercooler bypass tube 9 connected to the intermediate refrigerant tube 8 so as to bypass the intercooler 7; and the first intake return tube 92 for connecting the intercooler 7 and the intake side of the compression mechanism 2 during a state in which the refrigerant discharged from the first-stage compression element 2*c* is drawn into the second-stage compression element 2*d* via the intercooler bypass tube 9. However, this configuration may also be configured to be capable of switching between air-cooling operation and air-warming operation.

Figure 7:
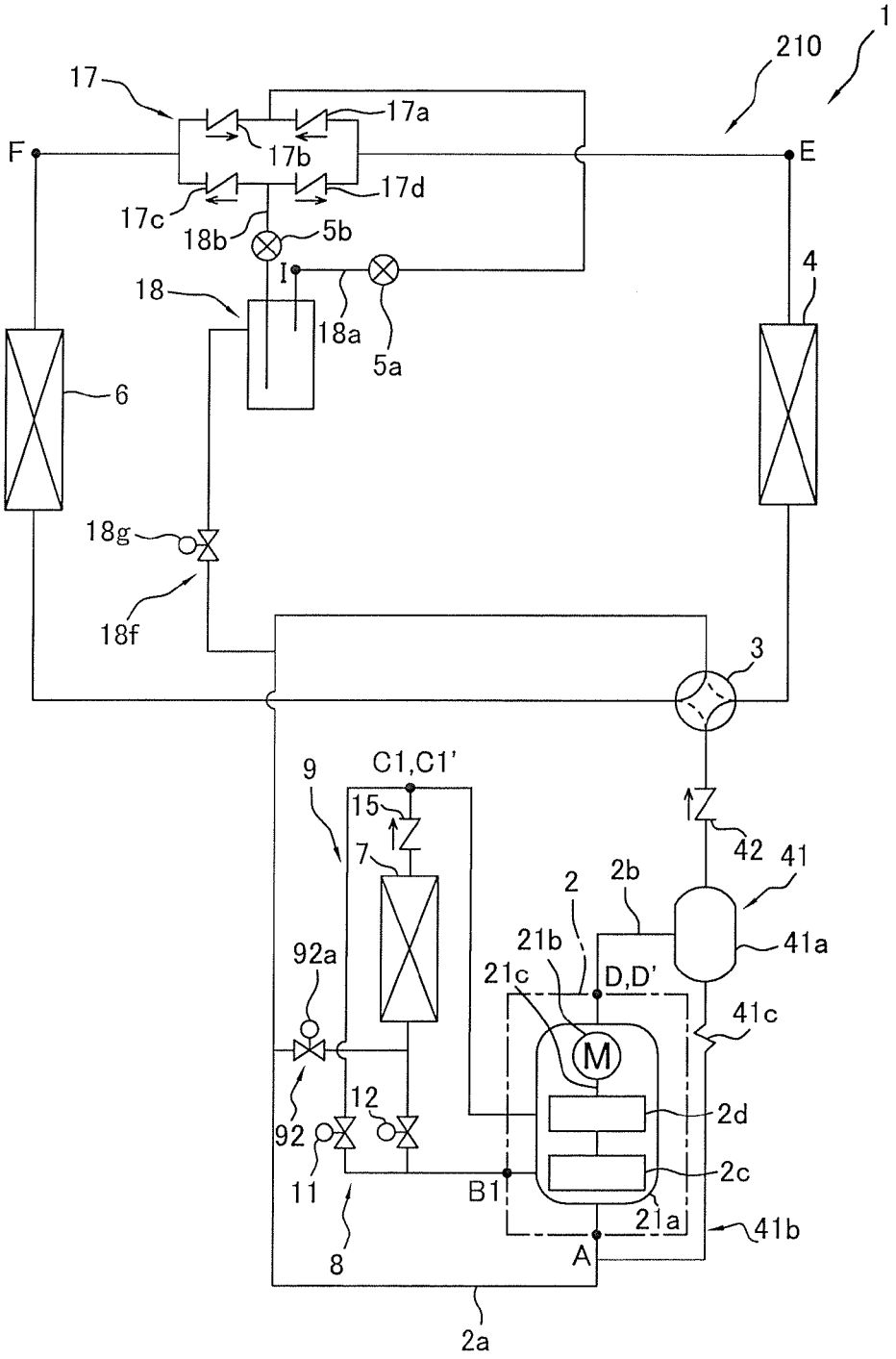
FIG. 7 is a schematic structural diagram of an air-conditioning apparatus according to Modification 2.

For example, the refrigerant circuit 10 (see FIG. 1) of the embodiment described above which employs a two-stage compression-type compression mechanism 2 may be modified to create a refrigerant circuit 210 in which a switching mechanism 3 is provided for enabling switching between air-cooling operation and air-warming operation, a first expansion mechanism 5*a* and a second expansion mechanism 5*b* are provided instead of the expansion mechanism 5, and a bridge circuit 17 and a receiver 18 are provided, as shown in FIG. 7.

The switching mechanism 3 is a mechanism for switching the direction of refrigerant flow in the refrigerant circuit 210. In order to allow the heat source-side heat exchanger 4 to function as a radiator of refrigerant discharged from the compression mechanism 2 and to allow the usage-side heat exchanger 6 to function as an evaporator of refrigerant cooled in the heat source-side heat exchanger 4 during the air-cooling operation, the switching mechanism 3 is capable of connecting the discharge side of the compression mechanism 2 and one end of the heat source-side heat exchanger 4 and also connecting the intake side of the compressor 21 and the usage-side heat exchanger 6 (refer to the solid lines of the switching mechanism 3 in FIG. 7, this state of the switching mechanism 3 is hereinbelow referred to as the "cooling operation state"). In order to allow the usage-side heat exchanger 6 to function as a radiator of refrigerant discharged from the compression mechanism 2 and to allow the heat source-side heat exchanger 4 to function as an evaporator of refrigerant cooled in the usage-side heat exchanger 6 during the air-warming operation, the switching mechanism 3 is capable of connecting the discharge side of the compression mechanism 2 and the usage-side heat exchanger 6 and also of connecting the intake side of the compression mechanism 2 and one end of the heat source-side heat exchanger 4 (refer to the dashed lines of the switching mechanism 3 in FIG. 7, this state of the switching mechanism 3 is hereinbelow referred to as the "heating operation state"). In the present modification, the switching mechanism 3 is a four-way switching valve connected to the intake side of the compression mechanism 2, the discharge side of the compression mechanism 2, the heat source-side heat exchanger 4, and the usage-side heat exchanger 6. The switching mechanism 3 is not limited to a four-way switching valve, and may be configured so as to have a function for switching the direction of the flow of the refrigerant in the same manner as described above by using, e.g., a combination of a plurality of electromagnetic valves.

Thus, the switching mechanism 3 is configured so as to be capable of switching between the cooling operation state in which refrigerant is circulated in sequence through the compression mechanism 2, the heat source-side heat exchanger 4, the first expansion mechanism 5*a*, the receiver 18, the second expansion mechanism 5*b*, and the usage-side heat exchanger 6; and the heating operation state in which refrigerant is circulated in sequence through the compression mechanism 2, the usage-side heat exchanger 6, the first expansion mechanism 5*a*, the receiver 18, the second expansion mechanism 5*b*, and the heat source-side heat exchanger 4.

The bridge circuit 17 is disposed between the heat source-side heat exchanger 4 and the usage-side heat exchanger 6, and is connected to a receiver inlet tube 18*a* connected to the inlet of the receiver 18 and to a receiver outlet tube 18*b* connected to the outlet of the receiver 18. The bridge circuit 17 has four non-return valves 17*a*, 17*b*, 17*c* and 17*d* in the present modification. The inlet non-return valve 17*a* is a non-return valve that allows only the flow of refrigerant from the heat source-side heat exchanger 4 to the receiver inlet tube 18*a*. The inlet non-return valve 17*b* is a non-return valve that allows only the flow of refrigerant from the usage-side heat exchanger 6 to the receiver inlet tube 18*a*. In other words, the inlet non-return valves 17*a*, 17*b* have a function for allowing refrigerant to flow from either the heat source-side heat exchanger 4 or the usage-side heat exchanger 6 to the receiver inlet tube 18*a*. The outlet non-return valve 17*c* is a non-return valve that allows only the flow of refrigerant from the receiver outlet tube 18*b* to the usage-side heat exchanger 6. The outlet non-return valve 17*d* is a non-return valve that allows only the flow of refrigerant from the receiver outlet tube 18*b* to the heat source-side heat exchanger 4. In other words, the outlet non-return valves 17*c*, 17*d* have a function for allowing refrigerant to flow from the receiver outlet tube 18*b* to either the heat source-side heat exchanger 4 or the usage-side heat exchanger 6.

The first expansion mechanism 5*a* is a mechanism for depressurizing the refrigerant, is provided to the receiver inlet tube 18*a*, and is an electrically driven expansion valve in the present modification. In the present modification, during air-cooling operation, the high-pressure refrigerant cooled in the heat source-side heat exchanger 4 is depressurized by the first expansion mechanism 5*a* to near the saturation pressure of the refrigerant before being sent to the usage-side heat exchanger 6 via the receiver 18, and during air-warming operation, the high-pressure refrigerant cooled in the usage-side heat exchanger 6 is depressurized by the first expansion mechanism 5*a* to near the saturation pressure of the refrigerant before being sent to the heat source-side heat exchanger 4 via the receiver 18.

The receiver 18 is a container provided to temporarily retain the refrigerant that has been depressurized by the first expansion mechanism 5*a*, so that it is possible to retain excess refrigerant that forms according to operating conditions such as differences in the flow rate of refrigerant circulated in the refrigerant circuit 210 between air-cooling operation and air-warming operation. The inlet of the receiver 18 is connected to the receiver inlet tube 18*a*, and the outlet of the receiver 18 is connected to the receiver outlet tube 18*b*. Also connected to the receiver 18 is a second intake return tube 18*f* capable of withdrawing refrigerant from inside the receiver 18 and returning the refrigerant to the intake tube 2*a* of the compression mechanism 2 (i.e., to the intake side of the compression element 2*c* on the first-stage side of the compression mechanism 2). A second intake return on/off valve 18*g* is provided to the second intake return tube 18*f*. The second intake return on/off valve 18*g* is an electromagnetic valve in the present modification.

The second expansion mechanism 5*b* is a mechanism provided to the receiver outlet tube 18*b* and used for depressurizing the refrigerant, and is an electrically driven expansion valve in the present modification. In the present modification, during air-cooling operation, the refrigerant depressurized by the first expansion mechanism 5*a* is further depressurized by the second expansion mechanism 5*b* to the low pressure of the refrigeration cycle before being sent to the usage-side heat exchanger 6 via the receiver 18, and during air-warming operation, the refrigerant depressurized by the first expansion mechanism 5*a* is further depressurized by the second expansion mechanism 5*b* to the low pressure of the refrigeration cycle before being sent to the heat source-side heat exchanger 4 via the receiver 18.

By using the bridge circuit 17, the receiver 18, the receiver inlet tube 18*a*, and the receiver outlet tube 18*b* in the present modification, when the switching mechanism 3 is brought to the cooling operation state, the high-pressure refrigerant cooled in the heat source-side heat exchanger 4 can be fed to the usage-side heat exchanger 6 through the inlet non-return valve 17*a* of the bridge circuit 17, the first expansion mechanism 5*a* of the receiver inlet tube 18*a*, the receiver 18, the second expansion mechanism 5*b* of the receiver outlet tube 18*b*, and the outlet non-return valve 17*c* of the bridge circuit 17. When the switching mechanism 3 is brought to the heating operation state, the high-pressure refrigerant cooled in the usage-side heat exchanger 6 can be fed to the heat source-side heat exchanger 4 through the inlet non-return valve 17*b* of the bridge circuit 17, the first expansion mechanism 5*a* of the receiver inlet tube 18*a*, the receiver 18, the second expansion mechanism 5*b* of the receiver outlet tube 18*b*, and the outlet non-return valve 17*d* of the bridge circuit 17.

During air-cooling operation in which the switching mechanism 3 is in the cooling operation state, the intercooler bypass on/off valve 11 of the intercooler bypass tube 9 is controlled so as to close (except for during air-cooling start control), the same as in the embodiment and modification thereof described above, and during air-warming operation in which the switching mechanism 3 is in the heating operation state, the intercooler bypass on/off valve 11 of the intercooler bypass tube 9 is controlled so as to open. During air-cooling operation in which the switching mechanism 3 is in the cooling operation state, the intercooler on/off valve 12 of the intermediate refrigerant tube 8 is controlled so as to open (except for during air-cooling start control), the same as in the embodiment and modification thereof described above, and during air-warming operation in which the switching mechanism 3 is in the heating operation state, the intercooler on/off valve 12 of the intermediate refrigerant tube 8 is controlled so as to close. Moreover, the first intake return on/off valve 92*a* of the first intake return tube 92 is controlled so as to open not only during air-cooling start control, but during air-warming operation in which the switching mechanism 3 is in the heating operation state.

Figure 8:
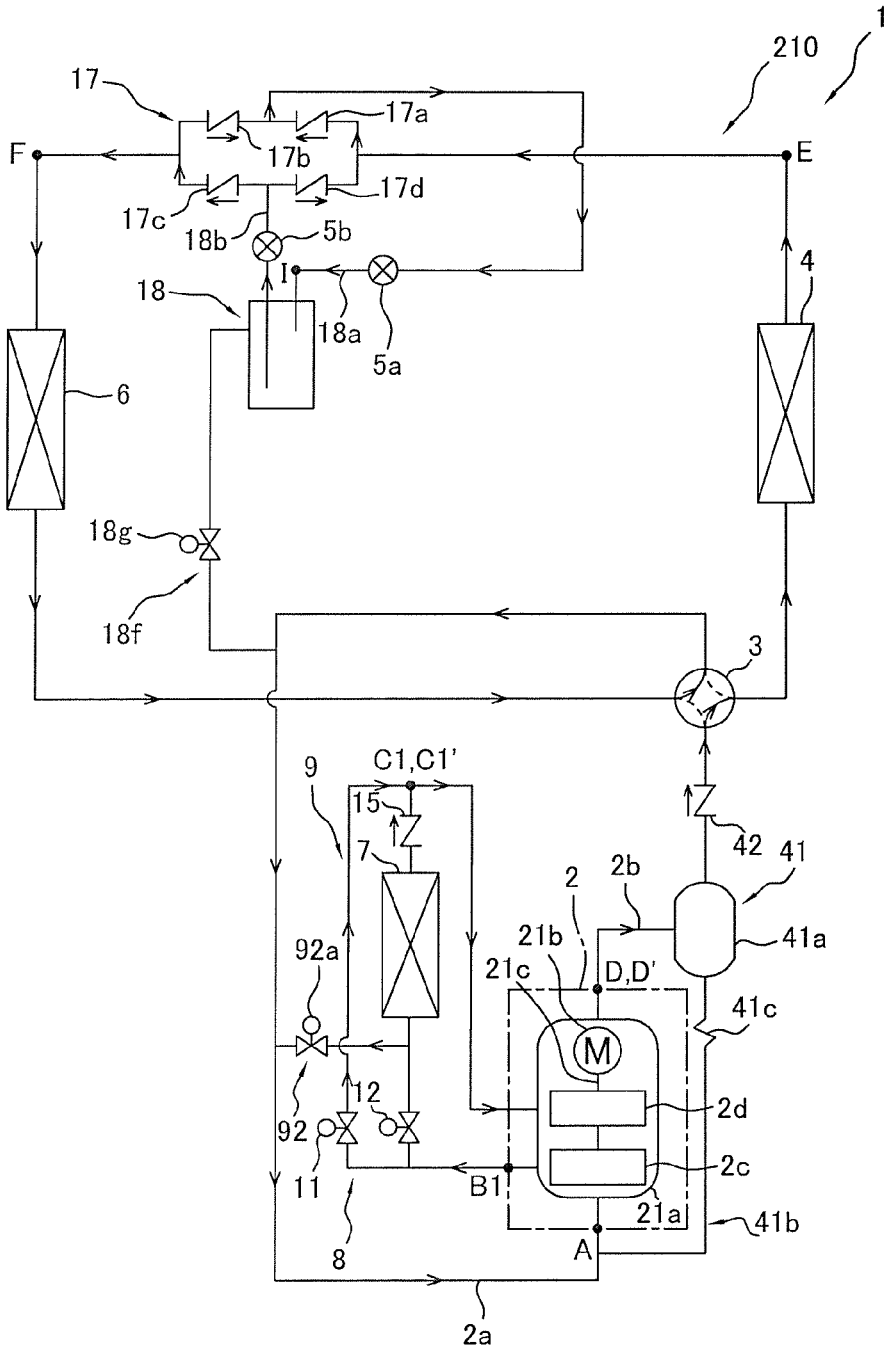
FIG. 8 is a diagram showing the flow of refrigerant within the air-conditioning apparatus during the air-cooling start control.
Figure 9:
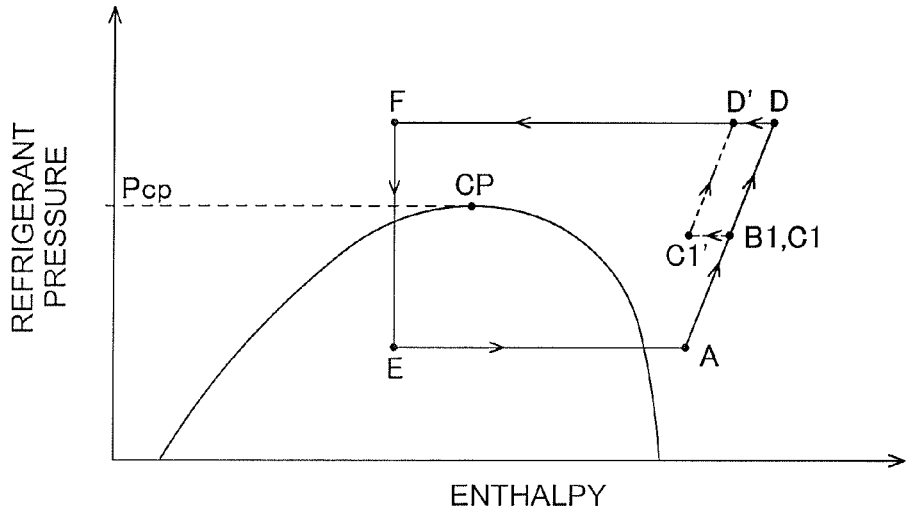
FIG. 9 is a pressure-enthalpy graph representing the refrigeration cycle during the air-warming operation in the air-conditioning apparatus according to Modification 2.
Figure 10:
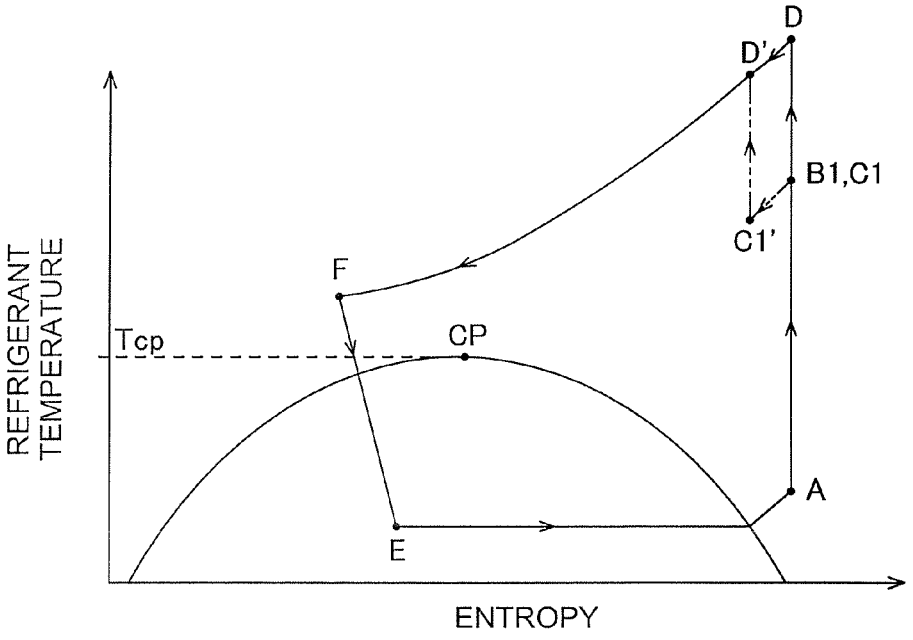
FIG. 10 is a temperature-entropy graph representing the refrigeration cycle during the air-warming operation in the air-conditioning apparatus according to Modification 2.
Figure 11:
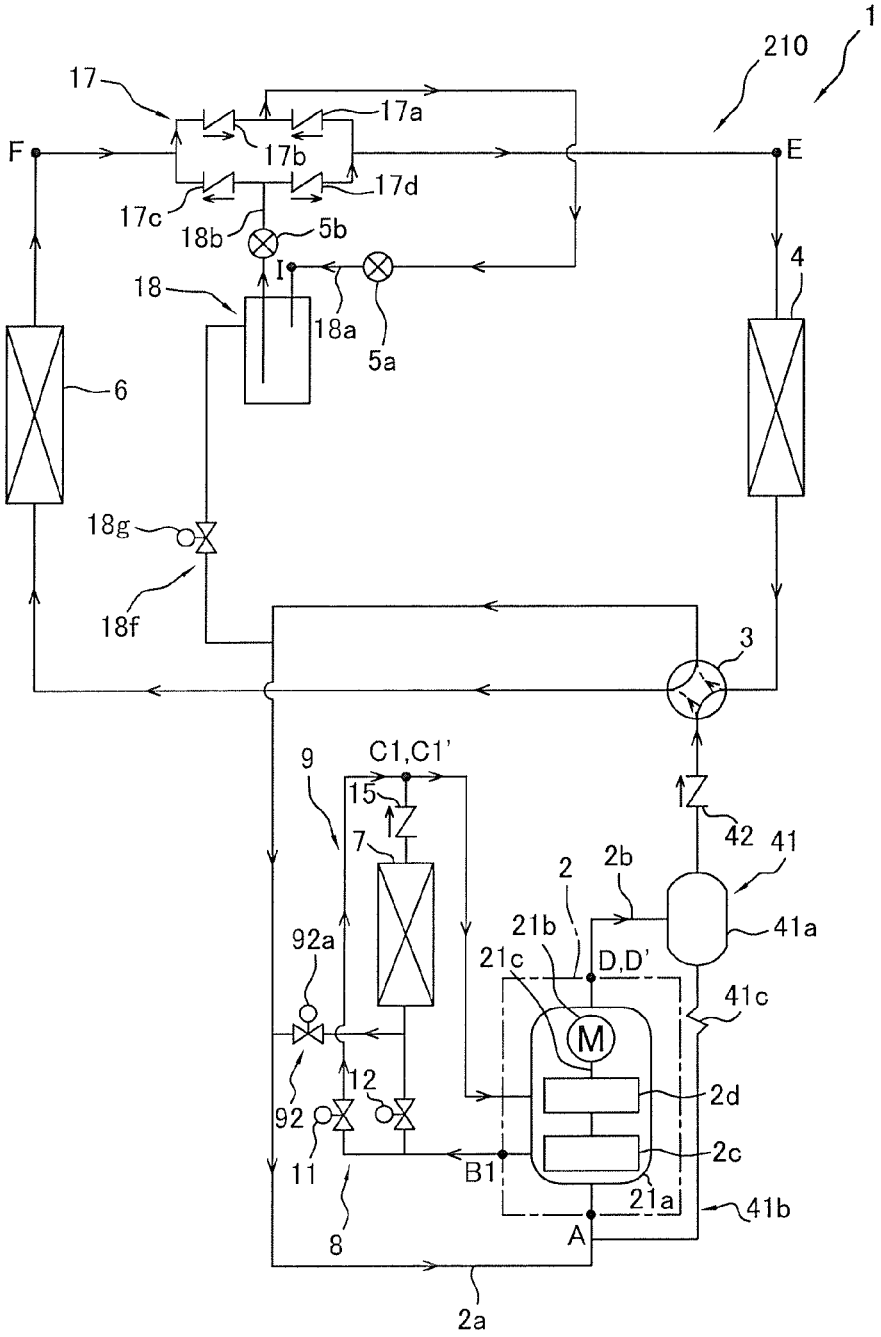
FIG. 11 is a diagram showing the flow of refrigerant within the air-conditioning apparatus during the air-warming operation.

Next, the action of the air-conditioning apparatus 1 of the present modification will be described using FIGS. 7, 2 through 4, and 8 through 11. FIG. 8 is a diagram showing the flow of refrigerant within the air-conditioning apparatus 1 during the air-cooling start control, FIG. 9 is a pressure-enthalpy graph representing the refrigeration cycle during the air-warming operation, FIG. 10 is a temperature-entropy graph representing the refrigeration cycle during the air-warming operation, and FIG. 11 is a diagram showing the flow of refrigerant within the air-conditioning apparatus 1 during the air-warming operation. The air-cooling start control and the refrigeration cycle during air-cooling operation will be described using FIGS. 2 through 4. Operational control of the air-cooling operation, air-cooling start control, and air-warming operation described below is performed by the control unit (not shown) of the embodiment described above. In the following description, the term "high pressure" means a high pressure in the refrigeration cycle (specifically, the pressure at points D, D', and E in FIGS. 2 and 3, and the pressure at points D, D', and F in FIGS. 9 and 10), the term "low pressure" means a low pressure in the refrigeration cycle (specifically, the pressure at points A and F in FIGS. 2 and 3, and the pressure at points A and E in FIGS. 9 and 10), and the term "intermediate pressure" means an intermediate pressure in the refrigeration cycle (specifically, the pressure at points B1, C1, and C1' in FIGS. 2, 3, 9, and 10).

<Air-Cooling Operation>

During the air-cooling operation, the switching mechanism 3 is brought to the cooling operation state shown by the solid lines in FIG. 7. The opening degrees of the first expansion mechanism 5*a* and the second expansion mechanism 5*b* are also adjusted. Since the switching mechanism 3 is in the cooling operation state, the intercooler on/off valve 12 of the intermediate refrigerant tube 8 is opened, and the intercooler bypass on/off valve 11 of the intercooler bypass tube 9 is closed, whereby the intercooler 7 is caused to function as a cooler. The first intake return on/off valve 92*a* of the first intake return tube 92 is also closed, thereby bringing about a state in which the intercooler 7 and the intake side of the compression mechanism 2 are not connected (except during the air-cooling start control described hereinafter).

When the refrigerant circuit 210 is in this state, low-pressure refrigerant (refer to point A in FIGS. 7, 2, and 3) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 7, 2, 3). The intermediate-pressure refrigerant discharged from the first-stage compression element 2*c* is cooled by heat exchange with water or air as a cooling source in the intercooler 7 (refer to point C1 in FIGS. 7, 2, and 3). The refrigerant cooled in the intercooler 7 is then led to and further compressed in the compression element 2*d* connected to the second-stage side of the compression element 2*c*, and the refrigerant is then discharged from the compression mechanism 2 to the discharge tube 2*b* (refer to point D in FIGS. 7, 2, and 3). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 2). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant radiator. The high-pressure refrigerant fed to the heat source-side heat exchanger 4 is cooled in the heat source-side heat exchanger 4 by heat exchange with water or air as a cooling source (refer to point E in FIGS. 7, 2, and 3). The high-pressure refrigerant cooled in the heat source-side heat exchanger 4 then flows into the receiver inlet tube 18*a* through the inlet non-return valve 17*a* of the bridge circuit 17, and is depressurized to a pressure near the saturation pressure by the first expansion mechanism 5*a* and temporarily retained in the receiver 18 (refer to point I in FIG. 7). The refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*c* of the bridge circuit 17 to the usage-side heat exchanger 6 functioning as a refrigerant evaporator (refer to point F in FIGS. 7, 2, and 3). The low-pressure gas-liquid two-phase refrigerant fed to the usage-side heat exchanger 6 is heated by heat exchange with water or air as a heating source, and the refrigerant evaporates as a result (refer to point A in FIGS. 7, 2, and 3). The low-pressure refrigerant heated in the usage-side heat exchanger 6 is then led back into the compression mechanism 2 via the switching mechanism 3. In this manner the air-cooling operation is performed.

In this manner, in the heat source-side heat exchanger 4 functioning as a radiator of high-pressure refrigerant in the air-conditioning apparatus 1 of the present modification, operating efficiency can be improved over cases in which no intercooler 7 is provided, because the temperature difference between the refrigerant and water or air as the cooling source can be reduced, the same as in the embodiment described above.

<Air-Cooling Start Control>

In the intercooler 7 of the present modification as well, there is a risk of liquid refrigerant accumulating in this intercooler 7 at such times as when the air-conditioning apparatus 1 is stopped, and when the air-cooling operation described above is started in a state in which liquid refrigerant has accumulated in the intercooler 7, since the liquid refrigerant accumulated in the intercooler 7 is drawn into the second-stage compression element 2*d*, liquid compression occurs in the second-stage compression element 2*d*, and the reliability of the compression mechanism 2 is reduced.

Therefore, in the present modification as well, air-cooling start control is performed so that the refrigerant discharged from the first-stage compression element 2*c* is drawn into the second-stage compression element 2*d* through the intercooler bypass tube 9, and the intercooler 7 and the intake side of the compression mechanism 2 are connected by the first intake return tube 92 at the start of the air-cooling operation described above, the same as in the embodiment described above.

The air-cooling start control in the present modification is the same as the air-cooling start control in the embodiment described above (refer to FIGS. 4 and 8), except that the switching mechanism 3 is placed in the cooling operation state in accordance with a command to start air-cooling operation. The air-cooling start control of the present modification therefore will not be described in detail.

Therefore, in the present modification as well, since the refrigerant discharged from the first-stage compression element 2*c* is drawn into the second-stage compression element 2*d* through the intercooler bypass tube 9, and the intercooler 7 and the intake side of the compression mechanism 2 are connected by the first intake return tube 92 at the start of air-cooling operation in which the switching mechanism 3 is in the cooling operation state, even when liquid refrigerant has accumulated in the intercooler 7 prior to the start of operation with the switching mechanism 3 in the cooling operation state, this liquid refrigerant can be drawn out to the outside of the intercooler 7, the same as in the embodiment described above. It is thereby possible to prevent a state in which liquid refrigerant has accumulated in the intercooler 7 at the start of operation with the switching mechanism 3 in the cooling operation state, there is no liquid compression in the second-stage compression element 2*d* due to accumulation of the liquid refrigerant in the intercooler 7, and the reliability of the compression mechanism 2 can be enhanced.

<Air-Warming Operation>

During the air-warming operation, the switching mechanism 3 is brought to the heating operation state shown by the dashed lines in FIGS. 7 and 11. The opening degrees of the first expansion mechanism 5*a* and the second expansion mechanism 5*b* are also adjusted. Since the switching mechanism 3 is set to a heating operation state, the intercooler on/off valve 12 of the intermediate refrigerant tube 8 is closed and the intercooler bypass on/off valve 11 of the intercooler bypass tube 9 is opened, thereby putting the intercooler 7 into a state of not functioning as a cooler. Furthermore, since the switching mechanism 3 is in the heating operation state, the first intake return on/off valve 92*a* of the first intake return tube 92 is opened, thereby causing the intercooler 7 and the intake side of the compression mechanism 2 to be connected.

When the refrigerant circuit 210 is in this state, low-pressure refrigerant (refer to point A in FIG. 7 and FIGS. 9 through 11) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIG. 7 and FIGS. 9 through 11). The intermediate-pressure refrigerant discharged from the first-stage compression element 2*c* passes through the intercooler bypass tube 9 (refer to point C1 in FIGS. 7, and 9 through 11) without passing through the intercooler 7 (i.e., without being cooled), unlike in the air-cooling operation. The refrigerant is drawn into and further compressed in the compression element 2*d* connected to the second-stage side of the compression element 2*c*, and is discharged from the compression mechanism 2 to the discharge tube 2*b* (refer to point D in FIGS. 7, and 9 through 11). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 9), similar to the air-cooling operation. The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3 and fed to the usage-side heat exchanger 6 functioning as a refrigerant radiator, and is cooled by heat exchange with water or air as a cooling source (refer to point F in FIGS. 7 and 9 through 11). The high-pressure refrigerant cooled in the usage-side heat exchanger 6 then flows into the receiver inlet tube 18*a* through the inlet non-return valve 17*b* of the bridge circuit 17, is depressurized by the first expansion mechanism 5*a* to a pressure near the saturation pressure, and is temporarily retained in the receiver 18 (refer to point I in FIGS. 7 and 11). The refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*d* of the bridge circuit 17 to the heat source-side heat exchanger 4 functioning as a refrigerant evaporator (refer to point E in FIGS. 7, and 9 to 11). The low-pressure gas-liquid two-phase refrigerant fed to the heat source-side heat exchanger 4 is heated by heat exchange with water or air as a heating source, and the refrigerant evaporates as a result (refer to point A in FIGS. 7, 9 through 11). The low-pressure refrigerant heated in the heat source-side heat exchanger 4 is then led back into the compression mechanism 2 via the switching mechanism 3. In this manner the air-warming operation is performed.

In the air-warming operation in which the switching mechanism 3 is in the heating operation state in the air-conditioning apparatus 1 of the present modification, the intercooler on/off valve 12 is closed, and the intercooler bypass on/off valve 11 is opened, thereby placing the intercooler 7 into a state of not functioning as a cooler. Temperature decreases are therefore minimized in the refrigerant discharged from the compression mechanism 2 (refer to points D, D' in FIG. 10) in comparison to a case in which only the intercooler 7 is provided, or a case in which the intercooler 7 is caused to function as a cooler in the same manner as during the air-cooling operation described above (in this case, the refrigeration cycle is performed in the sequence in FIGS. 9 and 10: point A→point B1→point C1'→point D'→point F→point E). Therefore, in the air-conditioning apparatus 1, heat radiation to the exterior can be minimized, temperature decreases can be minimized in the refrigerant supplied to the usage-side heat exchanger 6 functioning as a refrigerant radiator, reduction in heating performance can be minimized in proportion to the difference between the enthalpy difference of points D and F and the enthalpy difference of points D' and F in FIG. 9, and reduction in operating efficiency can be prevented, in comparison with cases in which only the intercooler 7 is provided or cases in which the intercooler 7 is made to function as a cooler similar to the air-cooling operation described above.

Furthermore, the air-conditioning apparatus 1 of the present modification is configured so that the refrigerant discharged from the first-stage compression element 2*c* is drawn into the second-stage compression element 2*d* via the intercooler bypass tube 9, and the intercooler 7 and the intake side of the compression mechanism 2 are connected via the first intake return tube 92 during air-warming operation as well in which the switching mechanism 3 is in the heating operation state, the same as at the start of air-cooling operation. It is therefore possible to prevent heat radiation loss to the outside from the intercooler 7 when the switching mechanism 3 is in the heating operation state, and a state can be created in which liquid refrigerant does not readily accumulate in the intercooler 7. In the air-conditioning apparatus 1 of the present modification, a reduction in heating performance in the usage-side heat exchanger 6 functioning as a refrigerant radiator can thereby be suppressed when the switching mechanism 3 is in the heating operation state, liquid refrigerant can be prevented from accumulating in the intercooler 7 at the start of operation in which the switching mechanism 3 is in the cooling operation state, and the refrigerant discharged from the first-stage compression element 2*c* can be drawn into the second-stage compression element 2*d* via the intercooler 7 without liquid compression occurring in the second-stage compression element 2*d* due to accumulation of liquid refrigerant in the intercooler 7.

In the present modification, switching between air-cooling operation and air-cooling start control, i.e., switching between the refrigerant non-return state and the refrigerant return state, is accomplished by the on/off states of the on/off valves 11, 12, 92*a*. However, an intercooler switching valve 93 may also be provided which is capable of switching between a refrigerant non-return state and a refrigerant return state, instead of the on/off valves 11, 12, 92*a*, as in Modification 1 described above.

(5) Modification 3

In Modification 2 described above, the air-conditioning apparatus 1 which performs a two-stage compression refrigeration cycle and is configured to be capable of switching between air-cooling operation and air-warming operation through the use of the switching mechanism 3 is provided with the intercooler 7 for functioning as a cooler for refrigerant discharged from the first-stage compression element 2*c* and drawn into the second-stage compression element 2*d*; the intercooler bypass tube 9 connected to the intermediate refrigerant tube 8 so as to bypass the intercooler 7; and the first intake return tube 92 for connecting the intercooler 7 and the intake side of the compression mechanism 2 during a state in which the refrigerant discharged from the first-stage compression element 2*c* is drawn into the second-stage compression element 2*d* via the intercooler bypass tube 9. However, this configuration may be modified so as to perform intermediate pressure injection by a first second-stage injection tube 19 and an economizer heat exchanger 20.

Figure 12:
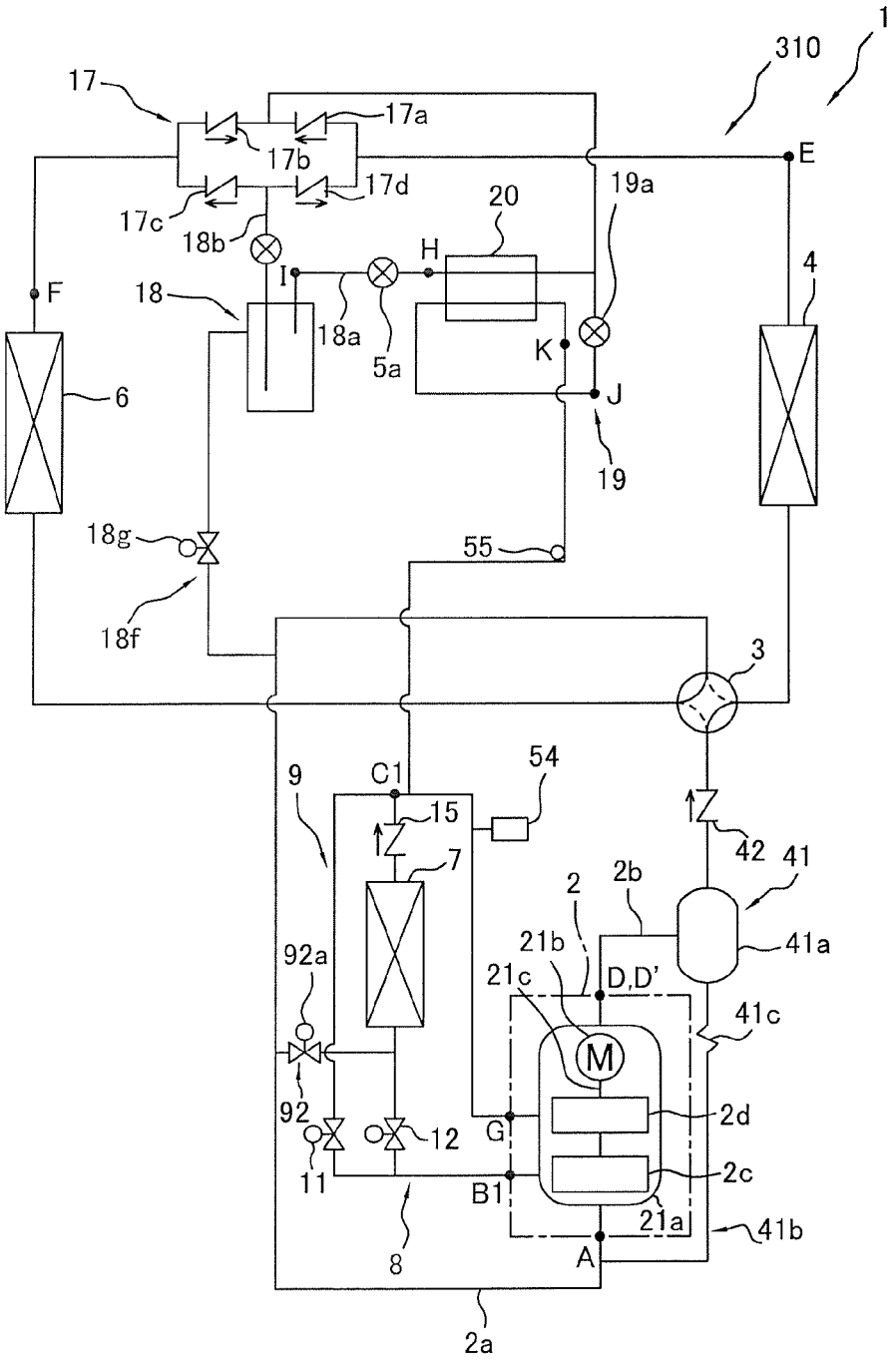
FIG. 12 is a schematic structural diagram of an air-conditioning apparatus according to Modification 3.

For example, as shown in FIG. 12, the refrigerant circuit 210 (refer to FIG. 7) according to Modification 2 which employs the two-stage compression-type compression mechanism 2 may be modified to create a refrigerant circuit 310 in which the first second-stage injection tube 19 and the economizer heat exchanger 20 are provided.

The first second-stage injection tube 19 has a function for branching off and returning the refrigerant flowing between the heat source-side heat exchanger 4 and the usage-side heat exchanger 6 to the second-stage compression element 2*d* of the compression mechanism 2. In the present modification, the first second-stage injection tube 19 is provided so as to branch off refrigerant flowing through the receiver inlet tube 18*a* and return the refrigerant to the intake side of the second-stage compression element 2*d*. More specifically, the first second-stage injection tube 19 is provided so as to branch off the refrigerant from a position upstream from the first expansion mechanism 5*a* of the receiver inlet tube 18*a* (i.e., a position between the heat source-side heat exchanger 4 and the first expansion mechanism 5*a* when the switching mechanism 3 is in the cooling operation state) and return the refrigerant to a position downstream from the intercooler 7 of the intermediate refrigerant tube 8. The first second-stage injection tube 19 is provided with a first second-stage injection valve 19*a* whose opening degree can be controlled. The first second-stage injection valve 19*a* is an electrically driven expansion valve in the present modification.

The economizer heat exchanger 20 is a heat exchanger for carrying out heat exchange between the refrigerant flowing between the heat source-side heat exchanger 4 and the usage-side heat exchanger 6 and the refrigerant that flows through the first second stage injection tube 19 (more specifically, the refrigerant that has been depressurized to near intermediate pressure in the first second-stage injection valve 19*a*). In the present modification, the economizer heat exchanger 20 is provided so as to exchange heat between the refrigerant flowing through the first second-stage injection tube 19 and the refrigerant flowing through a position upstream from the first expansion mechanism 5*a* of the receiver inlet tube 18*a* (i.e., a position between the heat source-side heat exchanger 4 and the first expansion mechanism 5*a* when the switching mechanism 3 is in the cooling operation state), and has flow channels whereby the refrigerant flowing through the first second-stage injection tube 19 and the refrigerant flowing through a position upstream from the first expansion mechanism 5*a* of the receiver inlet tube 18*a* both flow so as to oppose each other. In the present modification, the economizer heat exchanger 20 is provided downstream from the position at which the first second-stage injection tube 19 branches off from the receiver inlet tube 18*a*. Therefore, the refrigerant flowing between the heat source-side heat exchanger 4 and the usage-side heat exchanger 6 is branched off in the receiver inlet tube 18*a* into the first second-stage injection tube 19 before undergoing heat exchange in the economizer heat exchanger 20, and heat exchange is then conducted in the economizer heat exchanger 20 with the refrigerant flowing through the first second-stage injection tube 19.

In the present modification, when the switching mechanism 3 is brought to the cooling operation state, the high-pressure refrigerant cooled in the heat source-side heat exchanger 4 can be fed to the usage-side heat exchanger 6 through the inlet non-return valve 17*a* of the bridge circuit 17, the economizer heat exchanger 20, the first expansion mechanism 5*a* of the receiver inlet tube 18*a*, the receiver 18, the second expansion mechanism 5*b* of the receiver outlet tube 18*b*, and the outlet non-return valve 17*c* of the bridge circuit 17. When the switching mechanism 3 is brought to the heating operation state, the high-pressure refrigerant cooled in the usage-side heat exchanger 6 can be fed to the heat source-side heat exchanger 4 through the inlet non-return valve 17*b* of the bridge circuit 17, the economizer heat exchanger 20, the first expansion mechanism 5*a* of the receiver inlet tube 18*a*, the receiver 18, the second expansion mechanism 5*b* of the receiver outlet tube 18*b*, and the outlet non-return valve 17*d* of the bridge circuit 17.

Furthermore, in the present modification, the intermediate refrigerant tube 8 or the compression mechanism 2 is provided with an intermediate pressure sensor 54 for detecting the pressure of the refrigerant that flows through the intermediate refrigerant tube 8. The outlet of the first second stage injection tube 19 side of the economizer heat exchanger 20 is provided with an economizer outlet temperature sensor 55 for detecting the temperature of the refrigerant at the outlet of the first second stage injection tube 19 side of the economizer heat exchanger 20.

Figure 13:
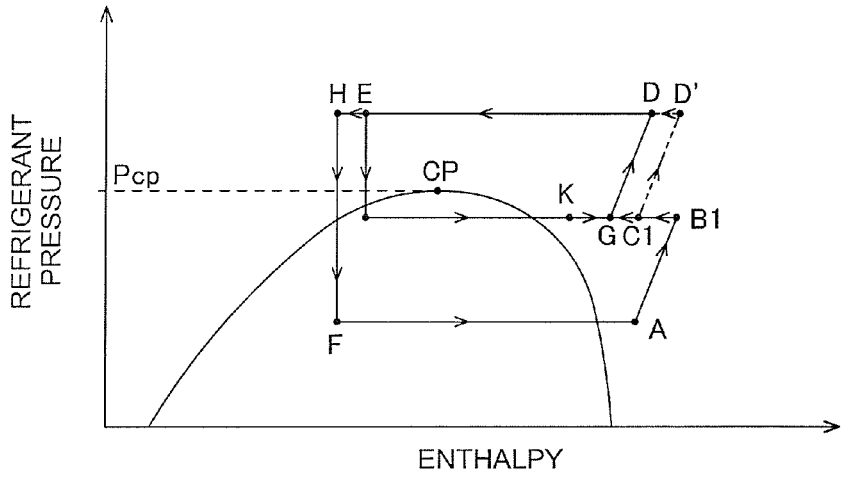
FIG. 13 is a pressure-enthalpy graph representing the refrigeration cycle during the air-cooling operation in the air-conditioning apparatus according to Modification 3.
Figure 14:
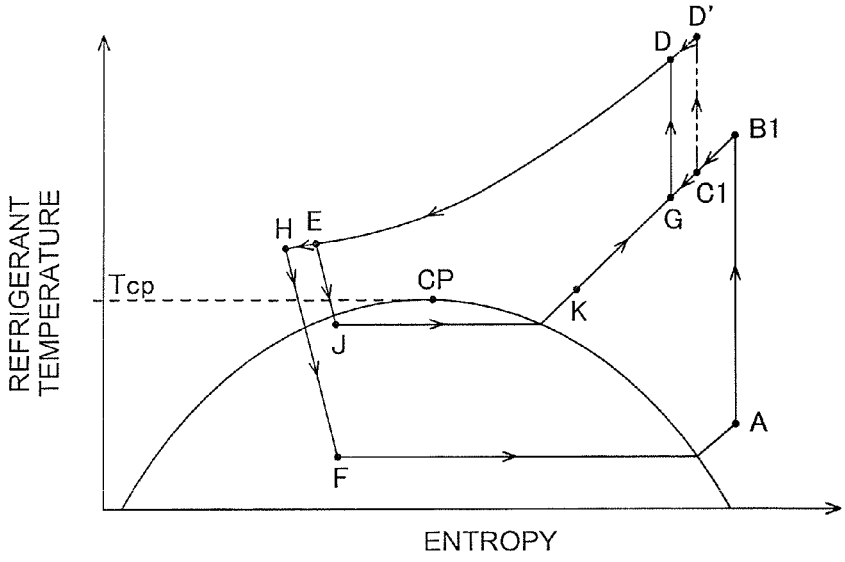
FIG. 14 is a temperature-entropy graph representing the refrigeration cycle during the air-cooling operation in the air-conditioning apparatus according to Modification 3.
Figure 15:
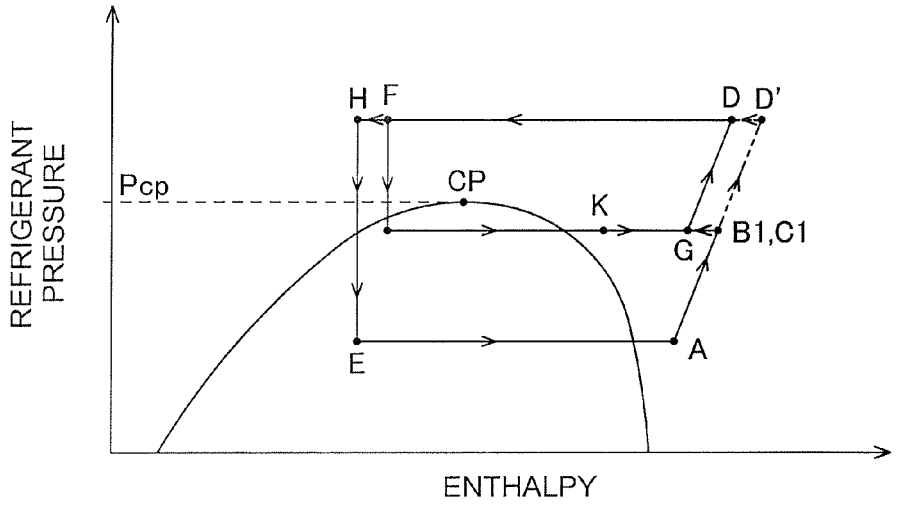
FIG. 15 is a pressure-enthalpy graph representing the refrigeration cycle during the air-warming operation in the air-conditioning apparatus according to Modification 3.
Figure 16:
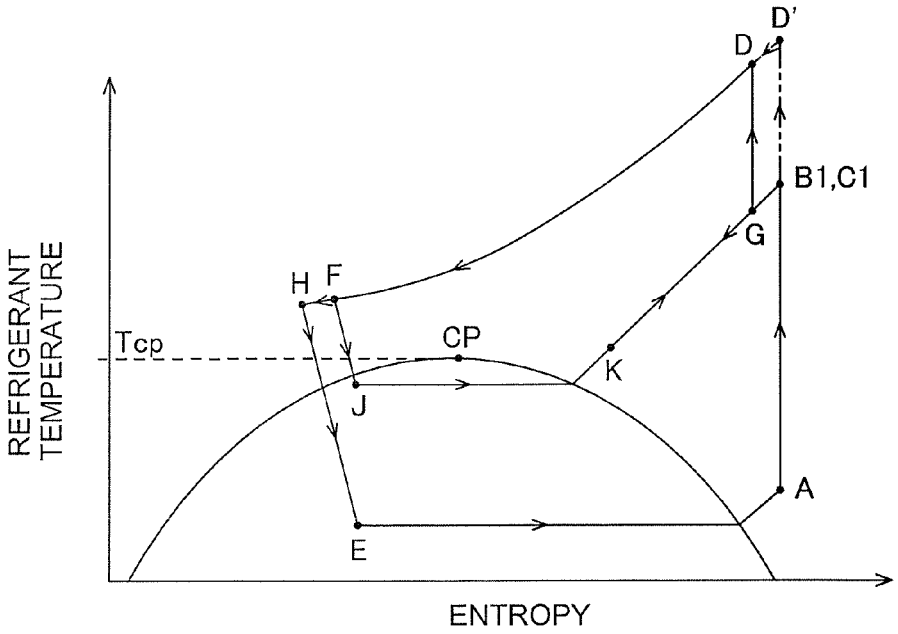
FIG. 16 is a temperature-entropy graph representing the refrigeration cycle during the air-warming operation in the air-conditioning apparatus according to Modification 3.

Next, the action of the air-conditioning apparatus 1 of the present modification will be described using FIGS. 12 through 16. FIG. 13 is a pressure-enthalpy graph representing the refrigeration cycle during the air-cooling operation, FIG. 14 is a temperature-entropy graph representing the refrigeration cycle during the air-cooling operation, FIG. 15 is a pressure-enthalpy graph representing the refrigeration cycle during the air-warming operation, and FIG. 16 is a temperature-entropy graph representing the refrigeration cycle during the air-warming operation. This air-cooling starting control is the same as that of Modification 2 described above and is therefore not described herein. Operational control of the air-cooling operation and air-warming operation (also including the air-cooling start control not described herein) described below is performed by the control unit (not shown) of the embodiment described above. In the following description, the term "high pressure" means a high pressure in the refrigeration cycle (specifically, the pressure at points D, D', E, and H in FIGS. 13 and 14, and the pressure at points D, D', F, and H in FIGS. 15 and 16), the term "low pressure" means a low pressure in the refrigeration cycle (specifically, the pressure at points A and F in FIGS. 13 and 14, and the pressure at points A and E in FIGS. 15 and 16), and the term "intermediate pressure" means an intermediate pressure in the refrigeration cycle (specifically, the pressure at points B1, C1, G, J, and K in FIGS. 13 through 16).

<Air-Cooling Operation>

During the air-cooling operation, the switching mechanism 3 is brought to the cooling operation state shown by the solid lines in FIG. 12. The opening degrees of the first expansion mechanism 5*a* and the second expansion mechanism 5*b* are also adjusted. Furthermore, the opening degree of the first second-stage injection valve 19*a* is also adjusted. More specifically, in the present embodiment, so-called superheat degree control is performed wherein the opening degree of the first second-stage injection valve 19*a* is adjusted so that a target value is achieved in the degree of superheat of the refrigerant at the outlet in the first second-stage injection tube 19 side of the economizer heat exchanger 20. In the present modification, the degree of superheat of the refrigerant at the outlet in the first second-stage injection tube 19 side of the economizer heat exchanger 20 is obtained by converting the intermediate pressure detected by the intermediate pressure sensor 54 to a saturation temperature and subtracting this refrigerant saturation temperature value from the refrigerant temperature detected by the economizer outlet temperature sensor 55. Though not used in the present modification, another possible option is to provide a temperature sensor to the inlet in the first second-stage injection tube 19 side of the economizer heat exchanger 20, and to obtain the degree of superheat of the refrigerant at the outlet in the first second-stage injection tube 19 side of the economizer heat exchanger 20 by subtracting the refrigerant temperature detected by this temperature sensor from the refrigerant temperature detected by the economizer outlet temperature sensor 55. Adjustment of the opening degree of the first second-stage injection valve 19*a* is also not limited to being performed by superheat degree control, and the first second-stage injection valve 19*a* may be opened to a predetermined opening degree in accordance with such factors as the flow rate of refrigerant circulated in the refrigerant circuit 10, for example. Since the switching mechanism 3 is in the cooling operation state, the intercooler on/off valve 12 of the intermediate refrigerant tube 8 is opened, and the intercooler bypass on/off valve 11 of the intercooler bypass tube 9 is closed, thereby creating a state in which the intercooler 7 functions as a cooler. The first intake return on/off valve 92*a* of the first intake return tube 92 is also closed, thereby creating a state in which the intercooler 7 and the intake side of the compression mechanism 2 are not connected (except during air-cooling start control).

When the refrigerant circuit 310 is in this state, low-pressure refrigerant (refer to point A in FIGS. 12 through 14) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 12 through 14). The intermediate-pressure refrigerant discharged from the first-stage compression element 2*c* is cooled by heat exchange with water or air as a cooling source in the intercooler 7 (refer to point C1 in FIGS. 12 to 14). The refrigerant cooled in the intercooler 7 is further cooled (refer to point G in FIGS. 12 to 14) by being mixed with refrigerant being returned from the first second-stage injection tube 19 to the second stage compression element 2*d* (refer to point K in FIGS. 12 to 14). Next, having been mixed with the refrigerant returning from the first second-stage injection tube 19 (i.e., intermediate pressure injection is carried out by the economizer heat exchanger 20), the intermediate-pressure refrigerant is led to and further compressed in the compression element 2*d* connected to the second-stage side of the compression element 2*c*, and the refrigerant is discharged from the compression mechanism 2 to the discharge tube 2*b* (refer to point D in FIGS. 12 through 14). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 13). The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3, and is fed to the heat source-side heat exchanger 4 functioning as a refrigerant radiator. The high-pressure refrigerant fed to the heat source-side heat exchanger 4 is cooled in the heat source-side heat exchanger 4 by heat exchange with water or air as a cooling source (refer to point E in FIGS. 12 through 14). The high-pressure refrigerant cooled in the heat source-side heat exchanger 4 flows through the inlet non-return valve 17*a* of the bridge circuit 17 into the receiver inlet tube 18*a*, and some of the refrigerant is branched off into the first second-stage injection tube 19. The refrigerant flowing through the first second-stage injection tube 19 is depressurized to a nearly intermediate pressure in the first second-stage injection valve 19*a* and is then fed to the economizer heat exchanger 20 (refer to point J in FIGS. 12 to 14). The refrigerant branched off to the first second-stage injection tube 19 then flows into the economizer heat exchanger 20, where it is cooled by heat exchange with the refrigerant flowing through the first second-stage injection tube 19 (refer to point H in FIGS. 12 to 14). The refrigerant flowing through the first second-stage injection tube 19 is heat-exchanged with the high-pressure refrigerant cooled in the heat source-side heat exchanger 4 functioning as a radiator, and heated (refer to point K in FIGS. 12 through 14), and merges with the intermediate-pressure refrigerant discharged from the first-stage compression element 2*c*, as described above. The high-pressure refrigerant cooled in the economizer heat exchanger 20 is depressurized to a nearly saturated pressure by the first expansion mechanism 5*a* and is temporarily retained in the receiver 18 (refer to point I in FIG. 12). The refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*c* of the bridge circuit 17 to the usage-side heat exchanger 6 functioning as a refrigerant evaporator (refer to point F in FIGS. 12 to 14). The low-pressure gas-liquid two-phase refrigerant fed to the usage-side heat exchanger 6 is heated by heat exchange with water or air as a heating source, and the refrigerant is evaporated as a result (refer to point A in FIGS. 12 to 14). The low-pressure refrigerant heated in the usage-side heat exchanger 6 is then led back into the compression mechanism 2 via the switching mechanism 3. In this manner the air-cooling operation is performed.

In the configuration of the present modification, as in Modification 2 described above, since the intercooler 7 is in a state of functioning as a cooler during the air-cooling operation in which the switching mechanism 3 is brought to the cooling operation state, heat radiation loss in the heat source-side heat exchanger 4 can be reduced in comparison with cases in which no intercooler 7 is provided.

Moreover, in the configuration of the present modification, since the first second-stage injection tube 19 and the economizer heat exchanger 20 are provided so as to branch off refrigerant fed from the heat source-side heat exchanger 4 to the expansion mechanisms 5*a*, 5*b* and return the refrigerant to the second-stage compression element 2*d*, the temperature of refrigerant drawn into the second-stage compression element 2*d* can be kept even lower (refer to points C1 and G in FIG. 14) without performing heat radiation to the exterior, such as is done with the intercooler 7. The temperature of refrigerant discharged from the compression mechanism 2 is thereby kept even lower (refer to points D and D' in FIG. 14), and operating efficiency can be further improved because heat radiation loss can be further reduced in proportion to the area enclosed by connecting the points C1, D', D, and G in FIG. 14, in comparison with cases in which no first second-stage injection tube 19 is provided.

Moreover, in the present modification as well, since the refrigerant discharged from the first-stage compression element 2*c* is drawn into the second-stage compression element 2*d* through the intercooler bypass tube 9, and the intercooler 7 and the intake side of the compression mechanism 2 are connected by the first intake return tube 92 at the start of air-cooling operation in which the switching mechanism 3 is in the cooling operation state, even when liquid refrigerant has accumulated in the intercooler 7 prior to the start of operation with the switching mechanism 3 in the cooling operation state, this liquid refrigerant can be drawn out to the outside of the intercooler 7, the same as in Modification 2 described above. It is thereby possible to prevent a state in which liquid refrigerant has accumulated in the intercooler 7 at the start of operation with the switching mechanism 3 in the cooling operation state, there is no liquid compression in the second-stage compression element 2*d* due to accumulation of the liquid refrigerant in the intercooler 7, and the reliability of the compression mechanism 2 can be enhanced.

<Air-Warming Operation>

During the air-warming operation, the switching mechanism 3 is brought to the heating operation state shown by the dashed lines in FIG. 12. The opening degrees of the first expansion mechanism 5*a* and the second expansion mechanism 5*b* are also adjusted. Furthermore, the opening degree of the first second-stage injection valve 19*a* is adjusted in the same manner as the air-cooling operation described above. Since the switching mechanism 3 is set to a heating operation state, the intercooler on/off valve 12 of the intermediate refrigerant tube 8 is closed and the intercooler bypass on/off valve 11 of the intercooler bypass tube 9 is opened, thereby putting the intercooler 7 into a state of not functioning as a cooler. Furthermore, since the switching mechanism 3 is in the heating operation state, the first intake return on/off valve 92*a* of the first intake return tube 92 is opened, thereby causing the intercooler 7 and the intake side of the compression mechanism 2 to be connected.

When the refrigerant circuit 310 is in this state, low-pressure refrigerant (refer to point A in FIG. 12 and FIGS. 15 through 16) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIG. 12, FIGS. 15, and 16). Unlike the air-cooling operation, the intermediate-pressure refrigerant discharged from the first-stage compression element 2*c* passes through the intercooler bypass tube 9 (refer to point C1 in FIGS. 12, 15, and 16) without passing through the intercooler 7 (i.e., without being cooled), and the refrigerant is cooled (refer to point G in FIGS. 12, 15, and 16) by being mixed with refrigerant being returned from the first second-stage injection tube 19 to the second-stage compression element 2*d* (refer to point K in FIGS. 12, 15, and 16). Next, having been mixed with the refrigerant returning from the first second-stage injection tube 19, the intermediate-pressure refrigerant is led to and further compressed in the compression element 2*d* connected to the second-stage side of the compression element 2*c*, and is discharged from the compression mechanism 2 to the discharge tube 2*b* (refer to point D in FIGS. 12, 15 and 16). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 15), similar to the air-cooling operation. The high-pressure refrigerant discharged from the compression mechanism 2 flows into the oil separator 41*a* constituting the oil separation mechanism 41, and the accompanying refrigeration oil is separated. The refrigeration oil separated from the high-pressure refrigerant in the oil separator 41*a* flows into the oil return tube 41*b* constituting the oil separation mechanism 41 wherein it is depressurized by the depressurization mechanism 41*c* provided to the oil return tube 41*b*, and the oil is then returned to the intake tube 2*a* of the compression mechanism 2 and led back into the compression mechanism 2. Next, having been separated from the refrigeration oil in the oil separation mechanism 41, the high-pressure refrigerant is passed through the non-return mechanism 42 and the switching mechanism 3 and fed to the usage-side heat exchanger 6 functioning as a refrigerant radiator, and is cooled by heat exchange with water or air as a cooling source (refer to point F in FIGS. 12, 15, and 16). The high-pressure refrigerant cooled in the usage-side heat exchanger 6 flows through the inlet non-return valve 17*b* of the bridge circuit 17 into the receiver inlet tube 18*a*, and some of the refrigerant is branched off into the first second-stage injection tube 19. The refrigerant flowing through the first second-stage injection tube 19 is depressurized to a nearly intermediate pressure in the first second-stage injection valve 19*a* and is then fed to the economizer heat exchanger 20 (refer to point J in FIGS. 12, 15, and 16). The refrigerant branched off to the first second-stage injection tube 19 then flows into the economizer heat exchanger 20, where it is cooled by heat exchange with the refrigerant flowing through the first second-stage injection tube 19 (refer to point H in FIGS. 12, 15, and 16). The refrigerant flowing through the first second-stage injection tube 19 is heat-exchanged with the high-pressure refrigerant cooled in the heat source-side heat exchanger 4 functioning as a radiator, and heated (refer to point K in FIGS. 12, 15 and 16); and merges with the intermediate-pressure refrigerant discharged from the first-stage compression element 2*c*, as described above. The high-pressure refrigerant cooled in the economizer heat exchanger 20 is depressurized to a nearly saturated pressure by the first expansion mechanism 5*a* and is temporarily retained in the receiver 18 (refer to point I in FIG. 12). The refrigerant retained in the receiver 18 is fed to the receiver outlet tube 18*b* and is depressurized by the second expansion mechanism 5*b* to become a low-pressure gas-liquid two-phase refrigerant, and is then fed through the outlet non-return valve 17*d* of the bridge circuit 17 to the heat source-side heat exchanger 4 functioning as a refrigerant evaporator (refer to point E in FIGS. 12, 15, and 16). The low-pressure gas-liquid two-phase refrigerant fed to the heat source-side heat exchanger 4 is heated by heat exchange with water or air as a heating source, and the refrigerant evaporates as a result (refer to point A in FIGS. 12, 15, and 16). The low-pressure refrigerant heated in the heat source-side heat exchanger 4 is then led back into the compression mechanism 2 via the switching mechanism 3. In this manner the air-warming operation is performed.

As in Modification 2 described above, in the air-warming operation in which the switching mechanism 3 is in the heating operation state in the configuration of the present modification, heat radiation to the outside is minimized, reductions in heating performance are suppressed, and reductions in operating efficiency can be prevented in comparison to a case in which only the intercooler 7 is provided, or a case in which the intercooler 7 is caused to function as a cooler in the same manner as during the air-cooling operation described above.

Moreover, in the configuration of the present modification, since the first second-stage injection tube 19 and the economizer heat exchanger 20 are provided so as to branch off refrigerant fed from the heat source-side heat exchanger 4 to the expansion mechanisms 5*a*, 5*b* and return the refrigerant to the second-stage compression element 2*d* in the same manner as the air-cooling operation, the temperature of refrigerant drawn into the second-stage compression element 2*d* can be kept even lower (refer to points B1 and G in FIG. 16) without performing heat radiation to the exterior, such as is done with the intercooler 7. The temperature of refrigerant discharged from the compression mechanism 2 is thereby kept even lower (refer to points D and D' in FIG. 16), and operating efficiency can be further improved because heat radiation loss can be reduced in proportion to the area enclosed by connecting the points B1, D', D, and G in FIG. 16, in comparison with cases in which no first second-stage injection tube 19 is provided.

Advantages of both the air-cooling operation and the air-warming operation in the configuration of the present modification are that the economizer heat exchanger 20 is a heat exchanger which has flow channels through which refrigerant fed from the heat source-side heat exchanger 4 or usage-side heat exchanger 6 to the expansion mechanisms 5*a*, 5*b* and refrigerant flowing through the first second-stage injection tube 19 both flow so as to oppose each other; therefore, it is possible to reduce the temperature difference between the refrigerant fed to the expansion mechanisms 5*a*, 5*b* from the heat source-side heat exchanger 4 or the usage-side heat exchanger 6 in the economizer heat exchanger 20 and the refrigerant flowing through the first second-stage injection tube 19, and high heat exchange efficiency can be achieved.

In the present modification as well, the refrigerant discharged from the first-stage compression element 2*c* is drawn into the second-stage compression element 2*d* via the intercooler bypass tube 9, and the intercooler 7 and the intake side of the compression mechanism 2 are connected via the first intake return tube 92 during air-warming operation as well in which the switching mechanism 3 is in the heating operation state, the same as in Modification 2 described above. It is therefore possible to prevent heat radiation loss to the outside from the intercooler 7 when the switching mechanism 3 is in the heating operation state, and a state can be created in which liquid refrigerant does not readily accumulate in the intercooler 7. A reduction in heating performance in the usage-side heat exchanger 6 functioning as a refrigerant radiator can thereby be suppressed during air-warming operation in which the switching mechanism 3 is in the heating operation state, liquid refrigerant can be prevented from accumulating in the intercooler 7 at the start of operation in which the switching mechanism 3 is in the cooling operation state, and the refrigerant discharged from the first-stage compression element 2*c* can be drawn into the second-stage compression element 2*d* via the intercooler 7 without liquid compression occurring in the second-stage compression element 2*d* due to accumulation of liquid refrigerant in the intercooler 7.

In the present modification, switching between air-cooling operation and air-cooling start control, i.e., switching between the refrigerant non-return state and the refrigerant return state, is accomplished by the on/off states of the on/off valves 11, 12, 92*a*. However, an intercooler switching valve 93 may also be provided which is capable of switching between a refrigerant non-return state and a refrigerant return state, instead of the on/off valves 11, 12, 92*a*, as in Modification 1 described above.

(6) Modification 4

In the refrigerant circuit 310 (refer to FIG. 12) in Modification 3 described above, in both the air-cooling operation in which the switching mechanism 3 is in the cooling operation state, and the air-warming operation in which the switching mechanism 3 is in the heating operation state, the temperature of the refrigerant discharged from the second-stage compression element 2*d* is reduced, the power consumption of the compression mechanism 2 is reduced, and operating efficiency is enhanced by performing intermediate pressure injection through the use of the economizer heat exchanger 20, as described above. Since intermediate pressure injection by the economizer heat exchanger 20 can also be used in conditions in which the intermediate pressure of the refrigeration cycle is increased to near critical pressure, a configuration having the single usage-side heat exchanger 6 such as that of the refrigerant circuits 10, 110, 210, 310 (refer to FIGS. 1 6, 7, and 12) in the embodiment and modifications thereof described above is considered to be particularly advantageous in cases in which a refrigerant for operating in a supercritical range is used.

However, it is sometimes the case that a configuration is adopted in which a plurality of usage-side heat exchangers 6 connected to each other in parallel are provided for such purposes as performing air-cooling and/or air-warming in accordance with the air conditioning loads of a plurality of air conditioning spaces, and a usage-side expansion mechanism 5*c* corresponding to each usage-side heat exchanger 6 is provided between each usage-side heat exchanger 6 and the receiver 18 functioning as a gas-liquid separator, in order to control the flow rate of refrigerant to each usage-side heat exchanger 6 and make it possible to obtain the necessary refrigeration load in each usage-side heat exchanger 6.

For example, though not shown in detail in the drawings, the refrigerant circuit 310 (refer to FIG. 12) having the bridge circuit 17 according to Modification 3 described above may have a configuration in which a plurality of (two in this case) usage-side heat exchangers 6 connected to each other in parallel are provided, a usage-side expansion mechanism 5*c* corresponding to each usage-side heat exchanger 6 is provided between each usage-side heat exchanger 6 and the receiver 18 (more specifically, the bridge circuit 17) functioning as a gas-liquid separator (refer to FIG. 17), the second expansion mechanism 5*b* provided to the receiver outlet tube 18*b* is omitted, and a third expansion mechanism for depressurizing the refrigerant to the low pressure of the refrigeration cycle during air-warming operation is provided instead of the outlet non-return valve 17*d* of the bridge circuit 17.

As in Modification 2 described above, intermediate pressure injection by the economizer heat exchanger 20 is advantageous also in the above-described configuration in conditions in which the difference in pressure from the high pressure of the refrigeration cycle to near the intermediate pressure of the refrigeration cycle can be utilized without significant depressurization other than by the first expansion mechanism 5*a* as a heat source-side expansion mechanism after the refrigerant has been cooled in the heat source-side heat exchanger 4 functioning as a radiator, as in the case of air-cooling operation in which the switching mechanism 3 is in the cooling operation state.

However, in conditions in which the usage-side expansion mechanisms 5*c* are controlling the flow rate of refrigerant flowing through the usage-side heat exchangers 6 as radiators so that the necessary refrigeration load is obtained in the usage-side heat exchangers 6 as radiators, and the flow rate of refrigerant passing through the usage-side heat exchangers 6 as radiators is roughly determined by refrigerant depressurization by control of the opening degree of the usage-side expansion mechanisms 5*c* provided downstream from the usage-side heat exchangers 6 as radiators and upstream from the economizer heat exchanger 20, such as during air-warming operation in which the switching mechanism 3 is in the heating operation state, the degree to which the refrigerant is depressurized by controlling the opening degree of the usage-side expansion mechanisms 5*c* varies according to not only the flow rate of refrigerant flowing through the usage-side heat exchangers 6 as radiators, but also to the state of flow rate distribution among the plurality of usage-side heat exchangers 6 as radiators, a state occurs in which the degree of depressurization varies significantly among the plurality of usage-side expansion mechanisms 5*c*, and the degree of depressurization in each usage-side expansion mechanism 5*c* is relatively large. There is accordingly a risk of reduced pressure of the refrigerant in the inlet of the economizer heat exchanger 20, in this case too little heat is exchanged in the economizer heat exchanger 20 (i.e., the flow rate of refrigerant flowing through the first second-stage injection tube 19), and the heat is difficult to utilize. Particularly in a case in which such an air-conditioning apparatus 1 is configured as a separate-type air conditioning apparatus in which a heat source unit including primarily the compression mechanism 2, the heat source-side heat exchanger 4, and the receiver 18, and a usage unit which includes primarily the usage-side heat exchanger 6 are connected by connecting piping, depending on the placement of the usage unit and the heat source unit, since the connecting piping can become extremely long, the effects of the resultant pressure drop combine to further reduce the pressure of the refrigerant in the inlet of the economizer heat exchanger 20. In cases in which there is a risk of reduced pressure of the refrigerant in the inlet of the economizer heat exchanger 20, intermediate pressure injection by a gas-liquid separator is advantageous in that it can be used even in conditions in which the difference in pressure between the gas-liquid separator pressure and the intermediate pressure (here, the pressure of the refrigerant flowing through the intermediate refrigerant tube 8) of the refrigeration cycle is small when the gas-liquid separator pressure is lower than the critical pressure.

Figure 17:
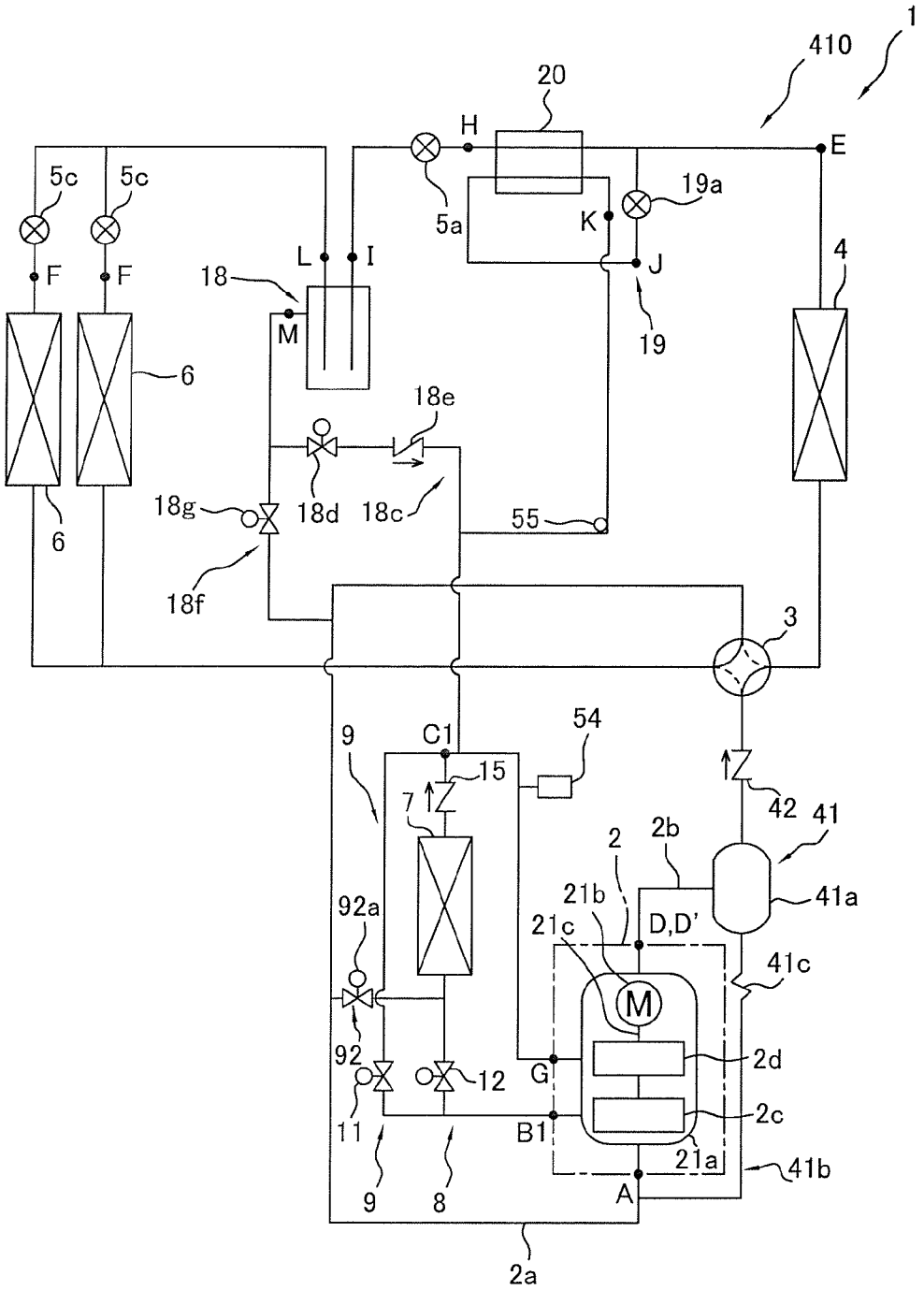
FIG. 17 is a schematic structural diagram of an air-conditioning apparatus according to Modification 4.

Therefore, in the present modification as shown in FIG. 17, in order to cause the receiver 18 to function as a gas-liquid separator and enable intermediate pressure injection, a second second-stage injection tube 18*c* is connected to the receiver 18, and a refrigerant circuit 410 is configured so that intermediate pressure injection by the economizer heat exchanger 20 can be performed during air-cooling operation, and intermediate pressure injection by the receiver 18 as a gas-liquid separator can be performed during air-warming operation.

The second second-stage injection tube 18*c* is a refrigerant tube capable of intermediate pressure injection for withdrawing refrigerant from the receiver 18 and returning the refrigerant to the second-stage compression element 2*d* of the compression mechanism 2, and in the present modification, the second second-stage injection tube 18*c* is provided so as to connect the upper part of the receiver 18 with the intermediate refrigerant tube 8 (i.e., the intake side of the second-stage compression element 2*d* of the compression mechanism 2). The second second-stage injection tube 18*c* is provided with a second second-stage injection on/off valve 18*d* and a second second-stage injection non-return mechanism 18*e*. The second second-stage injection on/off valve 18*d* is a valve capable of opening and closing, and is an electromagnetic valve in the present modification. The second second-stage injection non-return mechanism 18*e* is a mechanism for allowing refrigerant to flow from the receiver 18 to the second-stage compression element 2*d* and blocking the flow of refrigerant from the second-stage compression element 2*d* to the receiver 18, and is a non-return valve in the present embodiment. The portions of the second second-stage injection tube 18*c* and the second intake return tube 18*f* toward the receiver 18 are integrated. The portions of the second second-stage injection tube 18*c* and the first second-stage injection tube 19 toward the intermediate refrigerant tube 8 are also integrated. The usage-side expansion mechanism 5*c* is an electrically driven expansion valve in the present modification. Since the present modification is configured so that the first second-stage injection tube 19 and the economizer heat exchanger 20 are used during air-cooling operation and the second second-stage injection tube 18*c* is used during air-warming operation, as described above, there is no need for the direction of flow of the refrigerant to the economizer heat exchanger 20 to be constant irrespective of air-cooling operation or air-warming operation. The bridge circuit 17 is therefore omitted, and the structure of the refrigerant circuit 410 is simplified.

Figure 18:
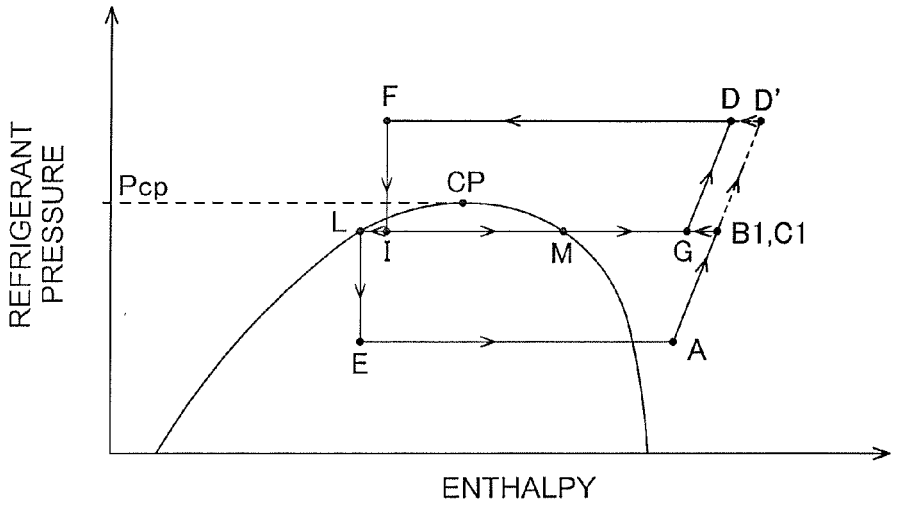
FIG. 18 is a pressure-enthalpy graph representing the refrigeration cycle during the air-warming operation in the air-conditioning apparatus according to Modification 4.
Figure 19:
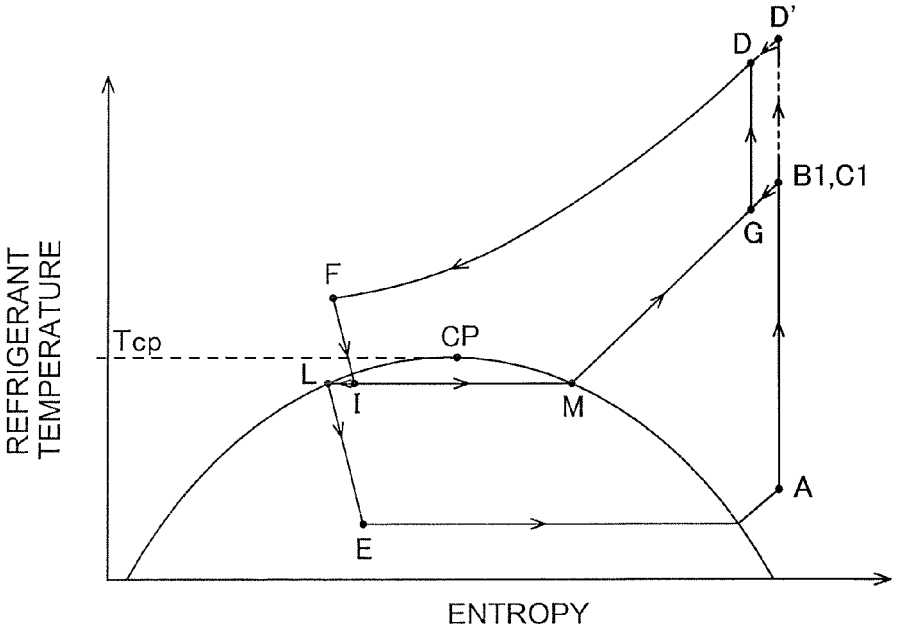
FIG. 19 is a temperature-entropy graph representing the refrigeration cycle during the air-warming operation in the air-conditioning apparatus according to Modification 4.

Next, the action of the air-conditioning apparatus 1 will be described using FIGS. 17, 13, 14, 18, and 19. FIG. 18 is a pressure-enthalpy graph representing the refrigeration cycle during the air-warming operation, and FIG. 19 is a temperature-entropy graph representing the refrigeration cycle during the air-warming operation. Here, the air-cooling start control is the same as that of Modification 2 described above and is therefore not described herein. The refrigeration cycle during air-cooling operation in the present modification is described using FIGS. 13 and 14. Operation controls during the following air-cooling operation and air-warming operation are performed by the controller (not shown) described in the embodiment above. In the following description, the term "high pressure" means a high pressure in the refrigeration cycle (specifically, the pressure at points D, D', E, and H in FIGS. 13 and 14, and the pressure at points D, D', and F in FIGS. 18 and 19), the term "low pressure" means a low pressure in the refrigeration cycle (specifically, the pressure at points A and F in FIGS. 13 and 14, and the pressure at points A and E in FIGS. 18 and 19), and the term "intermediate pressure" means an intermediate pressure in the refrigeration cycle (specifically, the pressure at points B1, C1, G, J, and K in FIGS. 13 and 14, and the pressure at points B1, C1, G, I, L, and M in FIGS. 18 and 19).

<Air-Cooling Operation>

During the air-cooling operation, the switching mechanism 3 is brought to the cooling operation state shown by the solid lines in FIG. 17. The opening degrees of the usage-side expansion mechanisms 5*c* and the first expansion mechanism 5*a* as the heat source-side expansion mechanism are adjusted. Since the switching mechanism 3 is in the cooling operation state, the intercooler on/off valve 12 of the intermediate refrigerant tube 8 is opened, and the intercooler bypass on/off valve 11 of the intercooler bypass tube 9 is closed, whereby the intercooler 7 is caused to function as a cooler. The first intake return on/off valve 92*a* of the first intake return tube 92 is also closed, thereby bringing about a state in which the intercooler 7 and the intake side of the compression mechanism 2 are not connected (except during the air-cooling start control). When the switching mechanism 3 is in the cooling operation state, intermediate pressure injection by the receiver 18 as a gas-liquid separator is not performed, and intermediate pressure injection by the economizer heat exchanger 20 is performed to return the refrigerant heated in the economizer heat exchanger 20 to the second-stage compression element 2*d* through the first second-stage injection tube 19. More specifically, the second second-stage injection on/off valve 18*d* is closed, and the opening degree of the first second-stage injection valve 19*a* is adjusted in the same manner as in Modification 3 described above.

When the refrigerant circuit 410 is in this state, low-pressure refrigerant (refer to point A in FIG. 17 and FIGS. 13 through 14) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIG. 17, FIGS. 13, and 14). The intermediate-pressure refrigerant discharged from the first-stage compression element 2*c* is cooled by heat exchange with water or air as a cooling source in the intercooler 7 (refer to point C1 in FIGS. 17, 13, and 14). The refrigerant cooled in the intercooler 7 is further cooled (refer to point G in FIGS. 17, 13, and 14) by being mixed with refrigerant being returned from the first second-stage injection tube 19 to the second-stage compression element 2*d* (refer to point K in FIGS. 17, 13, and 14). Next, having been mixed with the refrigerant returning from the first second-stage injection tube 19 (i.e., intermediate pressure injection is carried out by the economizer heat exchanger 20), the intermediate-pressure refrigerant is led to and further compressed in the compression element 2*d* connected to the second-stage side of the compression element 2*c*, and the refrigerant is discharged from the compression mechanism 2 to the discharge tube 2*b* (refer to point D in FIGS. 17, 13, and 14). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 13). The high-pressure refrigerant discharged from the compression mechanism 2 is fed via the switching mechanism 3 to the heat source-side heat exchanger 4 functioning as a refrigerant radiator, and the refrigerant is cooled by heat exchange with water or air as a cooling source (refer to point E in FIGS. 17, 13, and 14). A portion of the high-pressure refrigerant cooled in the heat source-side heat exchanger 4 functioning as a radiator is branched off into the first second-stage injection tube 19. The refrigerant flowing through the first second-stage injection tube 19 is depressurized to a nearly intermediate pressure in the first second-stage injection valve 19*a* and is then fed to the economizer heat exchanger 20 (refer to point J in FIGS. 17, 13, and 14). The refrigerant branched off to the first second-stage injection tube 19 then flows into the economizer heat exchanger 20, where it is cooled by heat exchange with the refrigerant flowing through the first second-stage injection tube 19 (refer to point H in FIGS. 17, 13, and 14). The refrigerant flowing through the first second-stage injection tube 19 is heat-exchanged with the high-pressure refrigerant cooled in the heat source-side heat exchanger 4 functioning as a radiator, and heated (refer to point K in FIGS. 17, 13, and 14), and merges with the intermediate-pressure refrigerant discharged from the first-stage compression element 2*c*, as described above. The high-pressure refrigerant cooled in the economizer heat exchanger 20 is depressurized to a nearly saturated pressure by the first expansion mechanism 5*a* and is temporarily retained in the receiver 18 (refer to point I in FIGS. 17, 13, and 14). The refrigerant retained in the receiver 18 is fed to the usage-side expansion mechanism 5*c* and depressurized by the usage-side expansion mechanisms 5*c* to become a low-pressure gas-liquid two-phase refrigerant, which is fed to the usage-side heat exchanger 6 functioning as a refrigerant evaporator (refer to point F in FIGS. 17, 13, and 14). The low-pressure gas-liquid two-phase refrigerant fed to the usage-side heat exchanger 6 that functions as an evaporator is heated by heat exchange with water or air as a heating source, and the refrigerant is evaporated as a result (refer to point A in FIGS. 17, 13, and 14). The low-pressure refrigerant heated and evaporated in the usage-side heat exchanger 6 that functions as an evaporator is then led back into the compression mechanism 2 via the switching mechanism 3. In this manner the air-cooling operation is performed.

<Air-Warming Operation>

During the air-warming operation, the switching mechanism 3 is brought to the heating operation state shown by the dashed lines in FIG. 17. The opening degrees of the usage-side expansion mechanisms 5*c* and the first expansion mechanism 5*a* functioning as the heat source-side expansion mechanism are adjusted. Since the switching mechanism 3 is set to a heating operation state, the intercooler on/off valve 12 of the intermediate refrigerant tube 8 is closed and the intercooler bypass on/off valve 11 of the intercooler bypass tube 9 is opened, thereby putting the intercooler 7 into a state of not functioning as a cooler. Furthermore, since the switching mechanism 3 is in the heating operation state, the first intake return on/off valve 92*a* of the first intake return tube 92 is opened, thereby causing the intercooler 7 and the intake side of the compression mechanism 2 to be connected. When the switching mechanism 3 is in the heating operation state, intermediate pressure injection by the economizer heat exchanger 20 is not performed, and intermediate pressure injection by the receiver 18 is performed to return the refrigerant from the receiver 18 functioning as a gas-liquid separator to the second-stage compression element 2*d* through the second second-stage injection tube 18*c*. More specifically, the second second-stage injection on/off valve 18*d* is open, and the first second-stage injection valve 19*a* is fully closed.

When the refrigerant circuit 410 is in this state, low-pressure refrigerant (refer to point A in FIGS. 17 through 19) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 17 through 19). Unlike the air-cooling operation, the intermediate-pressure refrigerant discharged from the first-stage compression element 2*c* passes through the intercooler bypass tube 9 (refer to point C1 in FIGS. 17 through 19) without passing through the intercooler 7 (i.e., without being cooled), and the refrigerant is cooled (refer to point G in FIGS. 17 through 19) by being mixed with refrigerant being returned from the receiver 18 via the second second-stage injection tube 18*c* to the second-stage compression element 2*d* (refer to point M in FIGS. 17 through 19). Next, having been mixed with the refrigerant returning from the second second-stage injection tube 18*c* (i.e., intermediate pressure injection is carried out by the receiver 18 which acts as a gas-liquid separator), the intermediate-pressure refrigerant is led to and further compressed in the compression element 2*d* connected to the second-stage side of the compression element 2*c*, and the refrigerant is discharged from the compression mechanism 2 to the discharge tube 2*b* (refer to point D in FIGS. 17 through 19). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 18), similar to the air-cooling operation. The high-pressure refrigerant discharged from the compression mechanism 2 is fed via the switching mechanism 3 to the usage-side heat exchanger 6 functioning as a refrigerant radiator, and the refrigerant is cooled by heat exchange with water or air as a cooling source (refer to point F in FIGS. 17 to 19). The high-pressure refrigerant cooled in the usage-side heat exchanger 6 functioning as a radiator is depressurized to near the intermediate pressure by the usage-side expansion mechanisms 5*c*, and is then temporarily retained in the receiver 18 and separated into gas and liquid (refer to points I, L, and M in FIGS. 17 through 19). The gas refrigerant separated in the receiver 18 is withdrawn from the upper part of the receiver 18 by the second second-stage injection tube 18*c*, and merges with the intermediate-pressure refrigerant discharged from the first-stage compression element 2*c*, as described above. The liquid refrigerant retained in the receiver 18 is depressurized by the first expansion mechanism 5*a* to become a low-pressure gas-liquid two-phase refrigerant, which is fed to the heat source-side heat exchanger 4 functioning as a refrigerant evaporator (refer to point E in FIGS. 17 through 19). The low-pressure gas-liquid two-phase refrigerant fed to the heat source-side heat exchanger 4 that functions as an evaporator is heated by heat exchange with water or air as a heating source, and the refrigerant is evaporated as a result (refer to point A in FIGS. 17, to 19). The low-pressure refrigerant heated and evaporated in the heat source-side heat exchanger 4 that functions as an evaporator is then led back into the compression mechanism 2 via the switching mechanism 3. In this manner the air-warming operation is performed.

The configuration of the present modification differs from Modification 3 in that intermediate pressure injection by the receiver 18 as a gas-liquid separator is performed instead of intermediate pressure injection by the economizer heat exchanger 20 during the air-warming operation, but the present modification otherwise produces the same operational effects as Modification 3.

In the present modification, switching between air-cooling operation and air-cooling start control, i.e., switching between the refrigerant non-return state and the refrigerant return state, is accomplished by the on/off states of the on/off valves 11, 12, 92*a*. However, an intercooler switching valve 93 may also be provided which is capable of switching between a refrigerant non-return state and a refrigerant return state, instead of the on/off valves 11, 12, 92*a*, as in Modification 1 described above.

(7) Modification 5

In the refrigerant circuit 410 (refer to FIG. 17) in Modification 4 described above, a configuration is adopted in which the plurality of usage-side heat exchangers 6 connected to each other in parallel are provided for such purposes as performing air-cooling and/or air-warming in accordance with the air conditioning loads of a plurality of air conditioning spaces, and the usage-side expansion mechanism 5*c* corresponding to each usage-side heat exchanger 6 is provided between each usage-side heat exchanger 6 and the receiver 18, in order to control the flow rate of refrigerant to each usage-side heat exchanger 6 and make it possible to obtain the necessary refrigeration load in each usage-side heat exchanger 6. In such a configuration, refrigerant depressurized by the first expansion mechanism 5*a* to near the saturation pressure and temporarily retained in the receiver 18 (refer to point I in FIG. 17) is distributed to each usage-side expansion mechanism 5*c* during the air-cooling operation, but when the refrigerant fed from the receiver 18 to each usage-side expansion mechanism 5*c* is in a gas-liquid two-phase state, there is a risk of drifting during distribution to each usage-side expansion mechanism 5*c*. The refrigerant fed from the receiver 18 to each usage-side expansion mechanism 5*c* is therefore preferably brought to as much a subcooled state as possible.

Figure 20:
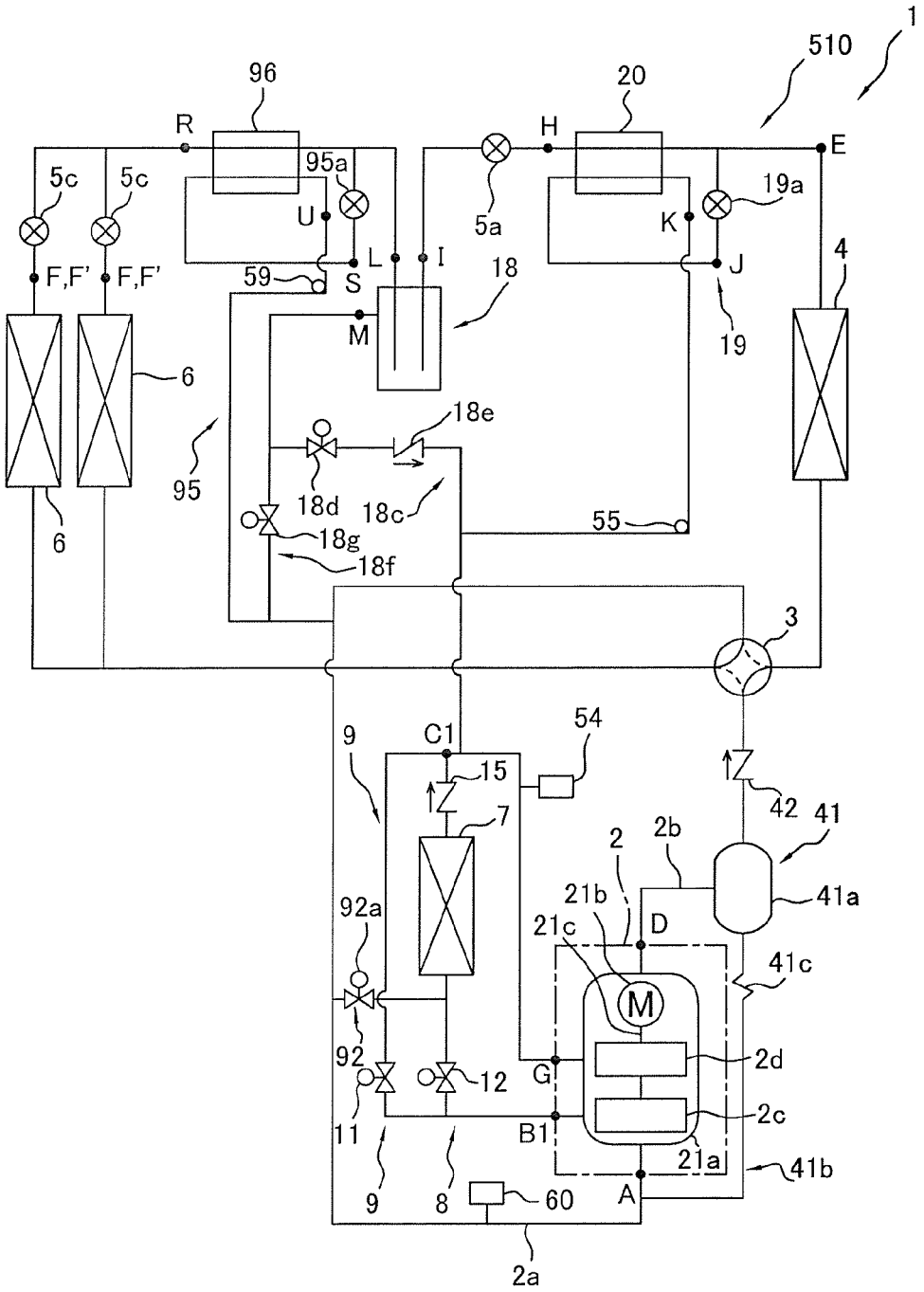
FIG. 20 is a schematic structural diagram of an air-conditioning apparatus according to Modification 5.

The refrigerant circuit 410 in Modification 4 described above is therefore configured in the present modification as a refrigerant circuit 510 in which a subcooling heat exchanger 96 and a third intake return tube 95 are provided between the receiver 18 and the usage-side expansion mechanisms 5*c*, as shown in FIG. 20.

The subcooling heat exchanger 96 is a heat exchanger for cooling the refrigerant fed from the receiver 18 to the usage-side expansion mechanisms 5*c*. More specifically, the subcooling heat exchanger 96 is a heat exchanger for carrying out heat exchange with the refrigerant flowing through the third intake return tube 95 for branching off a portion of the refrigerant fed from the receiver 18 to the usage-side expansion mechanisms 5*c* and returning the refrigerant to the intake side of the compression mechanism 2 (i.e., the intake tube 2*a* between the compression mechanism 2 and the usage-side heat exchanger 6 functioning as an evaporator) during air-cooling operation, and the subcooling heat exchanger 96 has flow channels through which both refrigerants flow so as to oppose each other. The third intake return tube 95 is a refrigerant tube for branching off the refrigerant fed to the expansion mechanism 5 from the heat source-side heat exchanger 4 functioning as a radiator and returning the refrigerant to the intake side of the compression mechanism 2 (i.e., the intake tube 2*a*). The third intake return tube 95 is provided with a third intake return valve 95*a* whose opening degree can be controlled, and heat exchange between the refrigerant fed from the receiver 18 to the usage-side expansion mechanisms 5*c* and the refrigerant flowing through the third intake return tube 95 after being depressurized to near the low pressure in the third intake return valve 95*a* is carried out in the subcooling heat exchanger 96. The third intake return valve 95*a* is an electromagnetic valve in the present modification. The intake tube 2*a* or the compression mechanism 2 is also provided with an intake pressure sensor 60 for detecting the pressure of the refrigerant flowing through the intake side of the compression mechanism 2. A subcooling heat exchanger outlet temperature sensor 59 for detecting the temperature of the refrigerant in the outlet of the subcooling heat exchanger 96 on the side of the third intake return tube 95 is provided to the outlet of the subcooling heat exchanger 96 on the side of the third intake return tube 95.

Figure 21:
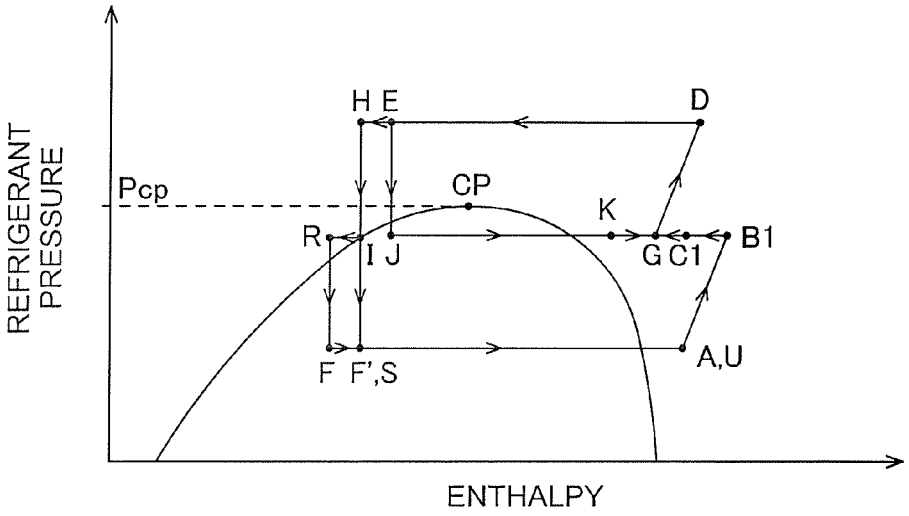
FIG. 21 is a pressure-enthalpy graph representing the refrigeration cycle during the air-cooling operation in the air-conditioning apparatus according to Modification 5.
Figure 22:
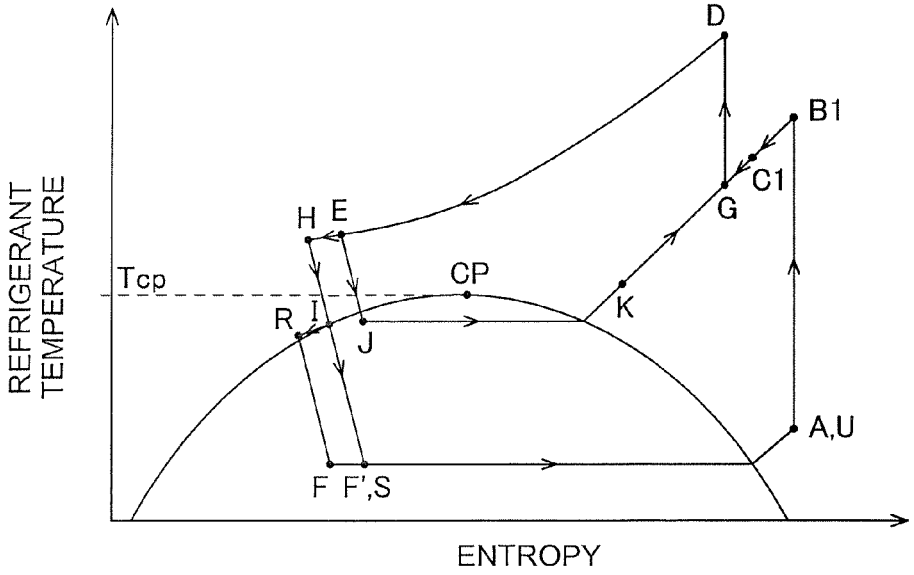
FIG. 22 is a temperature-entropy graph representing the refrigeration cycle during the air-cooling operation in the air-conditioning apparatus according to Modification 5.

Next, the action of the air-conditioning apparatus 1 in the present modification will be described using FIGS. 20 to 22, 18, and 19. FIG. 21 is a pressure-enthalpy graph representing the refrigeration cycle during the air-cooling operation, and FIG. 22 is a temperature-entropy graph representing the refrigeration cycle during the air-cooling operation. This air-cooling start control is the same as that of Modification 2 described above and is therefore not described herein. The refrigeration cycle during air-warming operation in the present modification is described using FIGS. 18 and 19. Operation controls during the following air-cooling operation and air-warming operation are performed by the controller (not shown) described in the embodiment above. In the following description, the term "high pressure" means a high pressure in the refrigeration cycle (specifically, the pressure at points D, E, I, and R in FIGS. 21 and 22, and the pressure at points D, D', and F in FIGS. 18 and 19), the term "low pressure" means a low pressure in the refrigeration cycle (specifically, the pressure at points A, F, F, S', and U in FIGS. 21 and 22, and the pressure at points A and E in FIGS. 18 and 19), and the term "intermediate pressure" means an intermediate pressure in the refrigeration cycle (specifically, the pressure at points B1, C1, G, J, and K in FIGS. 21 and 22, and the pressure at points B1, C1, G, I, L, and M in FIGS. 18 and 19).

<Air-Cooling Operation>

During the air-cooling operation, the switching mechanism 3 is brought to the cooling operation state shown by the solid lines in FIG. 20. The opening degrees of the usage-side expansion mechanisms 5*c* and the first expansion mechanism 5*a* as the heat source-side expansion mechanism are adjusted. Since the switching mechanism 3 is in the cooling operation state, the intercooler on/off valve 12 of the intermediate refrigerant tube 8 is opened, and the intercooler bypass on/off valve 11 of the intercooler bypass tube 9 is closed, whereby the intercooler 7 is caused to function as a cooler. The first intake return on/off valve 92*a* of the first intake return tube 92 is also closed, thereby bringing about a state in which the intercooler 7 and the intake side of the compression mechanism 2 are not connected (except during the air-cooling start control). When the switching mechanism 3 is in the cooling operation state, intermediate pressure injection by the receiver 18 as a gas-liquid separator is not performed, and intermediate pressure injection by the economizer heat exchanger 20 is performed to return the refrigerant heated in the economizer heat exchanger 20 to the second-stage compression element 2*d* through the first second-stage injection tube 19. More specifically, the second second-stage injection on/off valve 18*d* is closed, and the opening degree of the first second-stage injection valve 19*a* is adjusted in the same manner as in Modification 3 described above. Since the subcooling heat exchanger 96 is used when the switching mechanism 3 is in the cooling operation state, the opening degree of the third intake return valve 95*a* is also adjusted. More specifically, in the present modification, so-called superheat degree control is performed wherein the opening degree of the third intake return valve 95*a* is adjusted so that a target value is achieved in the degree of superheat of the refrigerant at the outlet in the third intake return tube 95 side of the subcooling heat exchanger 96. In the present modification, the degree of superheat of the refrigerant at the outlet in the third intake return tube 95 side of the subcooling heat exchanger 96 is obtained by converting the low pressure detected by the intake pressure sensor 60 to a saturation temperature and subtracting this refrigerant saturation temperature value from the refrigerant temperature detected by the subcooling heat exchanger outlet temperature sensor 59. Though not used in the present modification, another possible option is to provide a temperature sensor to the inlet in the third intake return tube 95 side of the subcooling heat exchanger 96, and to obtain the degree of superheat of the refrigerant at the outlet in the third intake return tube 95 side of the subcooling heat exchanger 96 by subtracting the refrigerant temperature detected by this temperature sensor from the refrigerant temperature detected by the subcooling heat exchanger outlet temperature sensor 59. The opening degree of the third intake return valve 95*a* is not limited to being adjusted by superheat degree control; the third intake return valve 95*a* may also be opened to a predetermined opening degree in accordance with such factors as the circulation rate of refrigerant in the refrigerant circuit 510, for example.

When the refrigerant circuit 510 is in this state, low-pressure refrigerant (refer to point A in FIGS. 20 through 22) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIGS. 20 through 22). The intermediate-pressure refrigerant discharged from the first-stage compression element 2*c* is cooled by heat exchange with water or air as a cooling source in the intercooler 7 (refer to point C1 in FIGS. 20 to 22). The refrigerant cooled in the intercooler 7 is further cooled (refer to point G in FIGS. 20 to 22) by being mixed with refrigerant being returned from the first second-stage injection tube 19 to the second-stage compression element 2*d* (refer to point K in FIGS. 20 to 22). Next, having been mixed with the refrigerant returning from the first second-stage injection tube 19 (i.e., intermediate pressure injection is carried out by the economizer heat exchanger 20), the intermediate-pressure refrigerant is led to and further compressed in the compression element 2*d* connected to the second-stage side of the compression element 2*c*, and the refrigerant is discharged from the compression mechanism 2 to the discharge tube 2*b* (refer to point D in FIGS. 20 through 22). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 21). The high-pressure refrigerant discharged from the compression mechanism 2 is fed via the switching mechanism 3 to the heat source-side heat exchanger 4 functioning as a refrigerant radiator, and the refrigerant is cooled by heat exchange with water or air as a cooling source (refer to point E in FIGS. 20 to 22). A portion of the high-pressure refrigerant cooled in the heat source-side heat exchanger 4 functioning as a radiator is branched off into the first second-stage injection tube 19. The refrigerant flowing through the first second-stage injection tube 19 is depressurized to a nearly intermediate pressure in the first second-stage injection valve 19*a* and is then fed to the economizer heat exchanger 20 (refer to point J in FIGS. 20 to 22). The refrigerant branched off to the first second-stage injection tube 19 then flows into the economizer heat exchanger 20, where it is cooled by heat exchange with the refrigerant flowing through the first second-stage injection tube 19 (refer to point H in FIGS. 20 to 22). The refrigerant flowing through the first second-stage injection tube 19 is heat-exchanged with the high-pressure refrigerant cooled in the heat source-side heat exchanger 4 functioning as a radiator, and heated (refer to point K in FIGS. 20 through 22), and merges with the intermediate-pressure refrigerant discharged from the first-stage compression element 2*c*, as described above. The high-pressure refrigerant cooled in the economizer heat exchanger 20 is depressurized to a nearly saturated pressure by the first expansion mechanism 5*a* and is temporarily retained in the receiver 18 (refer to point I in FIGS. 20 to 22). A portion of the refrigerant retained in the receiver 18 is then branched off into the third intake return tube 95. The refrigerant flowing through the third intake return tube 95 is depressurized to a nearly low pressure in the third intake return valve 95*a* and is then fed to the subcooling heat exchanger 96 (refer to point S in FIGS. 20 to 22). The refrigerant branched off to the third intake return tube 95 then flows into the subcooling heat exchanger 96, where it is further cooled by heat exchange with the refrigerant flowing through the third intake return tube 95 (refer to point R in FIGS. 20 to 22). The refrigerant flowing through the third intake return tube 95 is heat-exchanged with the high-pressure refrigerant cooled in the economizer heat exchanger 20, and heated (refer to point U in FIGS. 20 through 22), and merges with the refrigerant flowing through the intake side of the compression mechanism 2 (here, the intake tube 2*a*). This refrigerant cooled in the subcooling heat exchanger 96 is fed to the usage-side expansion mechanisms 5*c* and depressurized by the usage-side expansion mechanisms 5*c* to become a low-pressure gas-liquid two-phase refrigerant, which is fed to the usage-side heat exchanger 6 functioning as a refrigerant evaporator (refer to point F in FIGS. 20 through 22). The low-pressure gas-liquid two-phase refrigerant fed to the usage-side heat exchanger 6 that functions as an evaporator is heated by heat exchange with water or air as a heating source, and the refrigerant is evaporated as a result (refer to point A in FIGS. 20, to 22). The low-pressure refrigerant heated and evaporated in the usage-side heat exchanger 6 that functions as an evaporator is then led back into the compression mechanism 2 via the switching mechanism 3. In this manner the air-cooling operation is performed.

<Air-Warming Operation>

During the air-warming operation, the switching mechanism 3 is brought to the heating operation state shown by the dashed lines in FIG. 20. The opening degrees of the usage-side expansion mechanisms 5*c* and the first expansion mechanism 5*a* as the heat source-side expansion mechanism are adjusted. Since the switching mechanism 3 is set to a heating operation state, the intercooler on/off valve 12 of the intermediate refrigerant tube 8 is closed and the intercooler bypass on/off valve 11 of the intercooler bypass tube 9 is opened, thereby putting the intercooler 7 into a state of not functioning as a cooler. Furthermore, since the switching mechanism 3 is in the heating operation state, the first intake return on/off valve 92*a* of the first intake return tube 92 is opened, thereby causing the intercooler 7 and the intake side of the compression mechanism 2 to be connected. When the switching mechanism 3 is in the heating operation state, intermediate pressure injection by the economizer heat exchanger 20 is not performed, and intermediate pressure injection by the receiver 18 is performed to return the refrigerant from the receiver 18 functioning as a gas-liquid separator to the second-stage compression element 2*d* through the second second-stage injection tube 18*c*. More specifically, the second second-stage injection on/off valve 18*d* is open, and the first second-stage injection valve 19*a* is fully closed. Since the subcooling heat exchanger 96 is not used when the switching mechanism 3 is in the heating operation state, the third intake return valve 95*a* is also fully closed.

When the refrigerant circuit 510 is in this state, low-pressure refrigerant (refer to point A in FIG. 20 and FIGS. 18 through 19) is drawn into the compression mechanism 2 through the intake tube 2*a*, and after the refrigerant is first compressed to an intermediate pressure by the compression element 2*c*, the refrigerant is discharged to the intermediate refrigerant tube 8 (refer to point B1 in FIG. 20, FIGS. 18, and 19). Unlike the air-cooling operation, the intermediate-pressure refrigerant discharged from the first-stage compression element 2*c* passes through the intercooler bypass tube 9 (refer to point C1 in FIGS. 20, 18, and 19) without passing through the intercooler 7 (i.e., without being cooled), and the refrigerant is cooled (refer to point G in FIGS. 20, 18, and 19) by being mixed with refrigerant being returned from the receiver 18 via the second second-stage injection tube 18*c* to the second-stage compression element 2*d* (refer to point M in FIGS. 20, 18, and 19). Next, having been mixed with the refrigerant returning from the second second-stage injection tube 18*c* (i.e., intermediate pressure injection is carried out by the receiver 18 which acts as a gas-liquid separator), the intermediate-pressure refrigerant is led to and further compressed in the compression element 2*d* connected to the second-stage side of the compression element 2*c*, and the refrigerant is discharged from the compression mechanism 2 to the discharge tube 2*b* (refer to point D in FIGS. 20, 18, and 19). The high-pressure refrigerant discharged from the compression mechanism 2 is compressed by the two-stage compression action of the compression elements 2*c*, 2*d* to a pressure exceeding a critical pressure (i.e., the critical pressure Pcp at the critical point CP shown in FIG. 18), similar to the air-cooling operation. The high-pressure refrigerant discharged from the compression mechanism 2 is fed via the switching mechanism 3 to the usage-side heat exchanger 6 functioning as a refrigerant radiator, and the refrigerant is cooled by heat exchange with water or air as a cooling source (refer to point F in FIGS. 20, 18, and 19). The high-pressure refrigerant cooled in the usage-side heat exchanger 6 functioning as a radiator is depressurized to near the intermediate pressure by the usage-side expansion mechanisms 5*c*, and is then temporarily retained in the receiver 18 and separated into gas and liquid (refer to points I, L, and M in FIGS. 20, 18, and 19). The gas refrigerant separated in the receiver 18 is withdrawn from the upper part of the receiver 18 by the second second-stage injection tube 18*c*, and merges with the intermediate-pressure refrigerant discharged from the first-stage compression element 2*c*, as described above. The liquid refrigerant retained in the receiver 18 is depressurized by the first expansion mechanism 5*a* to become a low-pressure gas-liquid two-phase refrigerant, which is fed to the heat source-side heat exchanger 4 functioning as a refrigerant evaporator (refer to point E in FIGS. 20, 18, and 19). The low-pressure gas-liquid two-phase refrigerant fed to the heat source-side heat exchanger 4 that functions as an evaporator is heated by heat exchange with water or air as a heating source, and the refrigerant is evaporated as a result (refer to point A in FIGS. 20, 18, and 19). The low-pressure refrigerant heated and evaporated in the heat source-side heat exchanger 4 that functions as an evaporator is then led back into the compression mechanism 2 via the switching mechanism 3. In this manner the air-warming operation is performed.

The same operational effects are obtained in the configuration of the present modification as in Modification 4 described above, and since the refrigerant fed to the usage-side expansion mechanisms 5*c* from the receiver 18 during air-cooling operation (refer to point I in FIGS. 20 through 22) can be cooled to the subcooled state by the subcooling heat exchanger 96 (refer to points I and R in FIGS. 21 and 22), the risk of drift during distribution to the usage-side expansion mechanisms 5*c* can be reduced.

In the present modification, switching between air-cooling operation and air-cooling start control, i.e., switching between the refrigerant non-return state and the refrigerant return state, is accomplished by the on/off states of the on/off valves 11, 12, 92*a*. However, an intercooler switching valve 93 may also be provided which is capable of switching between a refrigerant non-return state and a refrigerant return state, instead of the on/off valves 11, 12, 92*a*, as in Modification 1 described above.

(8) Modification 6

In the embodiment and modifications thereof described above, the two-stage compression type compression mechanism 2, whereby the refrigerant discharged from a first-stage compression element of two compression elements 2*c*, 2*d* is sequentially compressed in a second-stage compression element, is configured by the single compressor 21 having a single-shaft, two-stage compression structure. However, a multi-stage compression mechanism having more than two compression stages, such as a three-stage compression mechanism or the like, may also be used, and a multi-stage compression mechanism may be configured by connecting, in series, a plurality of compressors having a single compression element and/or compressors having a plurality of compression elements. In cases in which the capability of the compression mechanism must be increased, such as when numerous usage-side heat exchangers 6 are connected, a parallel multi-stage compression-type compression mechanism may be employed in which two or more multi-stage compression mechanisms are connected in parallel.

Figure 23:
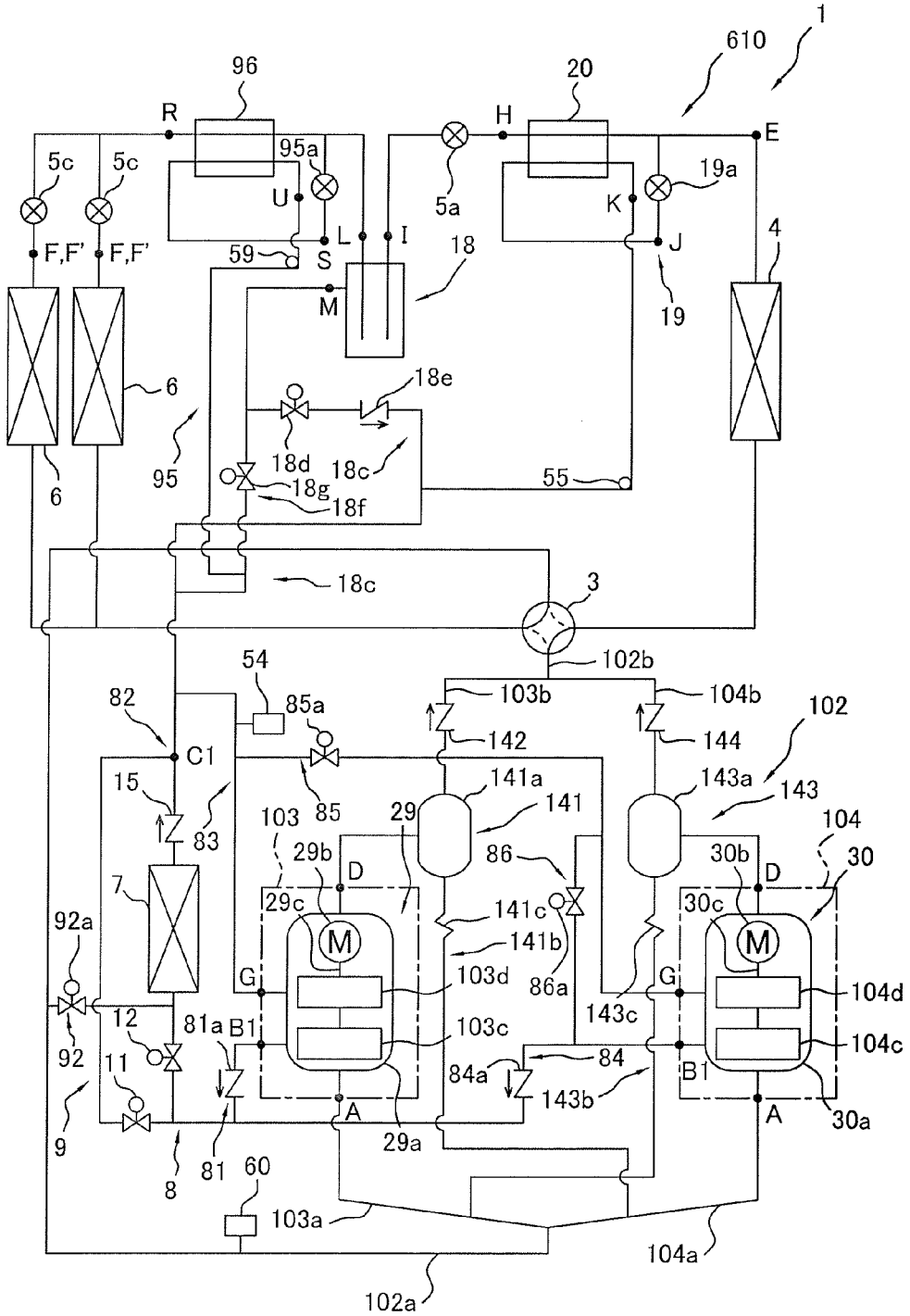
FIG. 23 is a schematic structural diagram of an air-conditioning apparatus according to Modification 6.

For example, as shown in FIG. 23, the refrigerant circuit 510 in Modification 5 described above (refer to FIG. 20) may be configured as a refrigerant circuit 610 that employs a compression mechanism 102 in which two-stage compression-type compression mechanisms 103, 104 are connected in parallel, instead of the two-stage compression-type compression mechanism 2.

In the present modification, the first compression mechanism 103 is configured by a compressor 29 for subjecting the refrigerant to two-stage compression through two compression elements 103*c*, 103*d*, and is connected to a first intake branch tube 103*a* which branches off from an intake header tube 102*a* of the compression mechanism 102, and also to a first discharge branch tube 103*b* whose flow merges with a discharge header tube 102*b* of the compression mechanism 102. In the present modification, the second compression mechanism 104 is configured by a compressor 30 for subjecting the refrigerant to two-stage compression through two compression elements 104*c*, 104*d*, and is connected to a second intake branch tube 104*a* which branches off from the intake header tube 102*a* of the compression mechanism 102, and also to a second discharge branch tube 104*b* whose flow merges with the discharge header tube 102*b* of the compression mechanism 102. Since the compressors 29, 30 have the same configuration as the compressor 21 in the embodiment and modifications thereof described above, symbols indicating components other than the compression elements 103*c*, 103*d*, 104*c*, 104*d* are replaced with symbols beginning with 29 or 30, and these components are not described. The compressor 29 is configured so that refrigerant is drawn from the first intake branch tube 103*a*, the refrigerant thus drawn in is compressed by the compression element 103*c* and then discharged to a first inlet-side intermediate branch tube 81 that constitutes the intermediate refrigerant tube 8, the refrigerant discharged to the first inlet-side intermediate branch tube 81 is caused to be drawn into the compression element 103*d* by way of an intermediate header tube 82 and a first discharge-side intermediate branch tube 83 constituting the intermediate refrigerant tube 8, and the refrigerant is further compressed and then discharged to the first discharge branch tube 103*b*. The compressor 30 is configured so that refrigerant is drawn in through the second intake branch tube 104*a*, the drawn-in refrigerant is compressed by the compression element 104*c* and then discharged to a second inlet-side intermediate branch tube 84 constituting the intermediate refrigerant tube 8, the refrigerant discharged to the second inlet-side intermediate branch tube 84 is drawn into the compression element 104*d* via the intermediate header tube 82 and a second discharge-side intermediate branch tube 85 constituting the intermediate refrigerant tube 8, and the refrigerant is further compressed and then discharged to the second discharge branch tube 104*b*. In the present modification, the intermediate refrigerant tube 8 is a refrigerant tube for sucking refrigerant discharged from the compression elements 103*c*, 104*c* connected to the first-stage sides of the compression elements 103*d*, 104*d* into the compression elements 103*d*, 104*d* connected to the second-stage sides of the compression elements 103*c*, 104*c*, and the intermediate refrigerant tube 8 primarily comprises the first inlet-side intermediate branch tube 81 connected to the discharge side of the first-stage compression element 103*c* of the first compression mechanism 103, the second inlet-side intermediate branch tube 84 connected to the discharge side of the first-stage compression element 104*c* of the second compression mechanism 104, the intermediate header tube 82 whose flow merges with both inlet-side intermediate branch tubes 81, 84, the first discharge-side intermediate branch tube 83 branching off from the intermediate header tube 82 and connected to the intake side of the second-stage compression element 103*d* of the first compression mechanism 103, and the second discharge-side intermediate branch tube 85 branching off from the intermediate header tube 82 and connected to the intake side of the second-stage compression element 104*d* of the second compression mechanism 104. The discharge header tube 102*b* is a refrigerant tube for feeding refrigerant discharged from the compression mechanism 102 to the switching mechanism 3. A first oil separation mechanism 141 and a first non-return mechanism 142 are provided to the first discharge branch tube 103*b* connected to the discharge header tube 102*b*. A second oil separation mechanism 143 and a second non-return mechanism 144 are provided to the second discharge branch tube 104*b* connected to the discharge header tube 102*b*. The first oil separation mechanism 141 is a mechanism whereby refrigeration oil that accompanies the refrigerant discharged from the first compression mechanism 103 is separated from the refrigerant and returned to the intake side of the compression mechanism 102. The first oil separation mechanism 141 mainly has a first oil separator 141*a* for separating from the refrigerant the refrigeration oil that accompanies the refrigerant discharged from the first compression mechanism 103, and a first oil return tube 141*b* that is connected to the first oil separator 141*a* and that is used for returning the refrigeration oil separated from the refrigerant to the intake side of the compression mechanism 102. The second oil separation mechanism 143 is a mechanism whereby refrigeration oil that accompanies the refrigerant discharged from the second compression mechanism 104 is separated from the refrigerant and returned to the intake side of the compression mechanism 102. The second oil separation mechanism 143 mainly has a second oil separator 143*a* for separating from the refrigerant the refrigeration oil that accompanies the refrigerant discharged from the second compression mechanism 104, and a second oil return tube 143*b* that is connected to the second oil separator 143*a* and that is used for returning the refrigeration oil separated from the refrigerant to the intake side of the compression mechanism 102. In the present modification, the first oil return tube 141*b* is connected to the second intake branch tube 104*a*, and the second oil return tube 143*c* is connected to the first intake branch tube 103*a*. Accordingly, a greater amount of refrigeration oil returns to the compression mechanism 103, 104 that has the lesser amount of refrigeration oil even when there is an imbalance between the amount of refrigeration oil that accompanies the refrigerant discharged from the first compression mechanism 103 and the amount of refrigeration oil that accompanies the refrigerant discharged from the second compression mechanism 104, which is due to the imbalance in the amount of refrigeration oil retained in the first compression mechanism 103 and the amount of refrigeration oil retained in the second compression mechanism 104. The imbalance between the amount of refrigeration oil retained in the first compression mechanism 103 and the amount of refrigeration oil retained in the second compression mechanism 104 is therefore resolved. In the present modification, the first intake branch tube 103*a* is configured so that the portion leading from the flow juncture with the second oil return tube 143*b* to the flow juncture with the intake header tube 102*a* slopes downward toward the flow juncture with the intake header tube 102*a*, while the second intake branch tube 104*a* is configured so that the portion leading from the flow juncture with the first oil return tube 141*b* to the flow juncture with the intake header tube 102*a* slopes downward toward the flow juncture with the intake header tube 102*a*. Therefore, even if either one of the compression mechanisms 103, 104 is stopped, refrigeration oil being returned from the oil return tube corresponding to the operating compression mechanism to the intake branch tube corresponding to the stopped compression mechanism is returned to the intake header tube 102*a*, and there will be little likelihood of a shortage of oil supplied to the operating compression mechanism. The oil return tubes 141*b*, 143*b* are provided with depressurizing mechanisms 141*c*, 143*c* for depressurizing the refrigeration oil that flows through the oil return tubes 141*b*, 143*b*. The non-return mechanisms 142, 144 are mechanisms for allowing refrigerant to flow from the discharge side of the compression mechanisms 103, 104 to the switching mechanism 3, and for shutting off the flow of refrigerant from the switching mechanism 3 to the discharge side of the compression mechanisms 103, 104.

Thus, in the present modification, the compression mechanism 102 is configured by connecting two compression mechanisms in parallel; namely, the first compression mechanism 103 having two compression elements 103*c*, 103*d* and configured so that refrigerant discharged from the first-stage compression element of these compression elements 103*c*, 103*d* is sequentially compressed by the second-stage compression element, and the second compression mechanism 104 having two compression elements 104*c*, 104*d* and configured so that refrigerant discharged from the first-stage compression element of these compression elements 104*c*, 104*d* is sequentially compressed by the second-stage compression element.

In the present modification, the intercooler 7 is provided to the intermediate header tube 82 constituting the intermediate refrigerant tube 8, and the intercooler 7 is a heat exchanger for cooling the conjoined flow of the refrigerant discharged from the first-stage compression element 103*c* of the first compression mechanism 103 and the refrigerant discharged from the first-stage compression element 104*c* of the second compression mechanism 104. Specifically, the intercooler 7 functions as a shared cooler for two compression mechanisms 103, 104. Accordingly, the circuit configuration is simplified around the compression mechanism 102 when the intercooler 7 is provided to the parallel-multistage-compression-type compression mechanism 102 in which a plurality of multistage-compression-type compression mechanisms 103, 104 are connected in parallel.

The first inlet-side intermediate branch tube 81 constituting the intermediate refrigerant tube 8 is provided with a non-return mechanism 81*a* for allowing the flow of refrigerant from the discharge side of the first-stage compression element 103*c* of the first compression mechanism 103 toward the intermediate header tube 82 and for blocking the flow of refrigerant from the intermediate header tube 82 toward the discharge side of the first-stage compression element 103*c*, while the second inlet-side intermediate branch tube 84 constituting the intermediate refrigerant tube 8 is provided with a non-return mechanism 84*a* for allowing the flow of refrigerant from the discharge side of the first-stage compression element 104*c* of the second compression mechanism 104 toward the intermediate header tube 82 and for blocking the flow of refrigerant from the intermediate header tube 82 toward the discharge side of the first-stage compression element 104*c*. In the present modification, non-return valves are used as the non-return mechanisms 81*a*, 84*a*. Therefore, even if either one of the compression mechanisms 103, 104 has stopped, there are no instances in which refrigerant discharged from the first-stage compression element of the operating compression mechanism passes through the intermediate refrigerant tube 8 and travels to the discharge side of the first-stage compression element of the stopped compression mechanism. Therefore, there are no instances in which refrigerant discharged from the first-stage compression element of the operating compression mechanism passes through the interior of the first-stage compression element of the stopped compression mechanism and exits out through the intake side of the compression mechanism 102, which would cause the refrigeration oil of the stopped compression mechanism to flow out, and it is thus unlikely that there will be insufficient refrigeration oil for starting up the stopped compression mechanism. In the case that the compression mechanisms 103, 104 are operated in order of priority (for example, in the case of a compression mechanism in which priority is given to operating the first compression mechanism 103), the stopped compression mechanism described above will always be the second compression mechanism 104, and therefore in this case only the non-return mechanism 84*a* corresponding to the second compression mechanism 104 need be provided.

In cases of a compression mechanism which prioritizes operating the first compression mechanism 103 as described above, since a shared intermediate refrigerant tube 8 is provided for both compression mechanisms 103, 104, the refrigerant discharged from the first-stage compression element 103*c* corresponding to the operating first compression mechanism 103 passes through the second discharge-side intermediate branch tube 85 of the intermediate refrigerant tube 8 and travels to the intake side of the second-stage compression element 104*d* of the stopped second compression mechanism 104, whereby there is a danger that refrigerant discharged from the first-stage compression element 103*c* of the operating first compression mechanism 103 will pass through the interior of the second-stage compression element 104*d* of the stopped second compression mechanism 104 and exit out through the discharge side of the compression mechanism 102, causing the refrigeration oil of the stopped second compression mechanism 104 to flow out, resulting in insufficient refrigeration oil for starting up the stopped second compression mechanism 104. In view of this, an on/off valve 85*a* is provided to the second discharge-side intermediate branch tube 85 in the present modification, and when the second compression mechanism 104 has stopped, the flow of refrigerant through the second discharge-side intermediate branch tube 85 is blocked by the on/off valve 85*a*. The refrigerant discharged from the first-stage compression element 103*c* of the operating first compression mechanism 103 thereby no longer passes through the second discharge-side intermediate branch tube 85 of the intermediate refrigerant tube 8 and travels to the intake side of the second-stage compression element 104*d* of the stopped second compression mechanism 104; therefore, there are no longer any instances in which the refrigerant discharged from the first-stage compression element 103*c* of the operating first compression mechanism 103 passes through the interior of the second-stage compression element 104*d* of the stopped second compression mechanism 104 and exits out through the discharge side of the compression mechanism 102 which causes the refrigeration oil of the stopped second compression mechanism 104 to flow out, and it is thereby even more unlikely that there will be insufficient refrigeration oil for starting up the stopped second compression mechanism 104. An electromagnetic valve is used as the on/off valve 85*a* in the present modification.

In the case of a compression mechanism which prioritizes operating the first compression mechanism 103, the second compression mechanism 104 is started up in continuation from the starting up of the first compression mechanism 103, but at this time, since a shared intermediate refrigerant tube 8 is provided for both compression mechanisms 103, 104, the starting up takes place from a state in which the pressure in the discharge side of the first-stage compression element 103*e* of the second compression mechanism 104 and the pressure in the intake side of the second-stage compression element 103*d* are greater than the pressure in the intake side of the first-stage compression element 103*c* and the pressure in the discharge side of the second-stage compression element 103*d*, and it is difficult to start up the second compression mechanism 104 in a stable manner. In view of this, in the present modification, there is provided a startup bypass tube 86 for connecting the discharge side of the first-stage compression element 104*c* of the second compression mechanism 104 and the intake side of the second-stage compression element 104*d*, and an on/off valve 86*a* is provided to this startup bypass tube 86. In cases in which the second compression mechanism 104 has stopped, the flow of refrigerant through the startup bypass tube 86 is blocked by the on/off valve 86*a* and the flow of refrigerant through the second discharge-side intermediate branch tube 85 is blocked by the on/off valve 85*a*. When the second compression mechanism 104 is started up, a state in which refrigerant is allowed to flow through the startup bypass tube 86 can be restored via the on/off valve 86*a*, whereby the refrigerant discharged from the first-stage compression element 104*c* of the second compression mechanism 104 is drawn into the second-stage compression element 104*d* via the startup bypass tube 86 without being mixed with the refrigerant discharged from the first-stage compression element 103*c* of the first compression mechanism 103, a state of allowing refrigerant to flow through the second discharge-side intermediate branch tube 85 can be restored via the on/off valve 85*a* at point in time when the operating state of the compression mechanism 102 has been stabilized (e.g., a point in time when the intake pressure, discharge pressure, and intermediate pressure of the compression mechanism 102 have been stabilized), the flow of refrigerant through the startup bypass tube 86 can be blocked by the on/off valve 86*a*, and operation can transition to the normal air-cooling operation. In the present modification, one end of the startup bypass tube 86 is connected between the on/off valve 85*a* of the second discharge-side intermediate branch tube 85 and the intake side of the second-stage compression element 104*d* of the second compression mechanism 104, while the other end is connected between the discharge side of the first-stage compression element 104*c* of the second compression mechanism 104 and the non-return mechanism 84*a* of the second inlet-side intermediate branch tube 84, and when the second compression mechanism 104 is started up, the startup bypass tube 86 can be kept in a state of being substantially unaffected by the intermediate pressure portion of the first compression mechanism 103. An electromagnetic valve is used as the on/off valve 86*a* in the present modification.

The actions of the air-conditioning apparatus 1 of the present modification during the air-cooling operation and the air-warming operation, and the like are essentially the same as the actions in the above-described Modification 5 (FIGS. 20 through 22, 18, and 19 and the relevant descriptions), except that the points modified by the circuit configuration surrounding the compression mechanism 102 are somewhat more complex due to the compression mechanism 102 being provided instead of the compression mechanism 2, for which reason the actions are not described herein.

The same operational effects as those of Modification 5 described above can also be achieved with the configuration of the present modification.

In the present modification, switching between air-cooling operation and air-cooling start control, i.e., switching between the refrigerant non-return state and the refrigerant return state, is accomplished by the on/off states of the on/off valves 11, 12, 92*a*. However, an intercooler switching valve 93 may also be provided which is capable of switching between a refrigerant non-return state and a refrigerant return state, instead of the on/off valves 11, 12, 92*a*, as in Modification 1 described above.

(9) Other Embodiments

Embodiments of the present invention and modifications thereof are described above with reference to the drawings, but the specific configuration is not limited to these embodiments or their modifications, and can be changed within a range that does not deviate from the scope of the invention.

For example, in the above-described embodiment and modifications thereof, the present invention may be applied to a so-called chiller-type air-conditioning apparatus in which water or brine is used as a heating source or cooling source for conducting heat exchange with the refrigerant flowing through the usage-side heat exchanger 6, and a secondary heat exchanger is provided for conducting heat exchange between indoor air and the water or brine that has undergone heat exchange in the usage-side heat exchanger 6.

The present invention can also be applied to other types of refrigeration apparatuses besides the above-described chiller-type air-conditioning apparatus, as long as the apparatus performs a multistage compression refrigeration cycle by using a refrigerant that operates in a supercritical range as its refrigerant.

The refrigerant that operates in a supercritical range is not limited to carbon dioxide; ethylene, ethane, nitric oxide, and other gases may also be used.

Industrial Applicability

The present invention makes it possible to prevent liquid compression in the second-stage compression element, and to enhance the reliability of the compression mechanism in a refrigeration apparatus which performs a multi-stage compression refrigeration cycle.

What is claimed is:

1. A refrigeration apparatus, comprising a compression mechanism having a plurality of compression elements, refrigerant discharged from a first-stage compression element of the plurality of compression elements being sequentially compressed by a second-stage compression element of the plurality of compression elements;

a heat source-side heat exchanger;

a usage-side heat exchanger;

an intermediate refrigerant tube drawing refrigerant discharged from the first-stage compression element into the second-stage compression element;

an intercooler disposed along the intermediate refrigerant tube and dividing the intermediate refrigerant tube into an inlet side portion connected to an outlet of the first-stage compression element and an inlet side of the intercooler, and an outlet side portion connected to an intake side of the second-stage compression element and an outlet side of the intercooler, the intercooler cooling the refrigerant discharged from the first-stage compression element into the inlet side portion and supplying cooled refrigerant into the outlet side portion to be drawn into the second-stage compression element;

an intercooler bypass tube connected to the intermediate refrigerant tube and bypassing the intercooler;

an intake return tube branching from the inlet side portion of the intermediate refrigerant tube on the inlet side of the intercooler to an intake side of the first stage compression element of the compression mechanism to fluidly communicate refrigerant in the inlet side portion prior to passing through the intercooler to the intake side of the first-stage compression element when the refrigerant discharged from the first-stage compression element is drawn into the second-stage compression element through the intercooler bypass tube; and a switching mechanism switching between a cooling operation state in which refrigerant is circulated in sequence through the compression mechanism, the heat source-side heat exchanger, and the usage-side heat exchanger, and a heating operation state in which refrigerant is circulated in sequence through the compression mechanism, the usage-side heat exchanger, and the heat source-side heat exchanger, the intercooler bypass tube connecting the refrigerant discharged from the first-stage compression element into the second-stage compression element at the start of operation in which the switching mechanism is in the cooling operation state, and the intake return tube connecting the intercooler and the intake side of the compression mechanism at the start of operation in which the switching mechanism is in the cooling operation state.

2. The refrigeration apparatus according to claim 1, further comprising an intercooler switching valve switching between a refrigerant non-return state in which the refrigerant discharged from the first-stage compression element is drawn into the second-stage compression element via the intercooler, and the intercooler and the intake side of the compression mechanism are not connected via the intake return tube, and a refrigerant return state in which the refrigerant discharged from the first-stage compression element is drawn into the second-stage compression element through the intercooler bypass tube, and the intercooler and the intake side of the compression mechanism are connected via the intake return tube.

3. The refrigeration apparatus according to claim 1, wherein the intercooler bypass tube connecting the refrigerant discharged from the first-stage compression element into the second-stage compression element when the switching mechanism is in the heating operation state, and the intake return tube connecting the intercooler and the intake side of the compression mechanism when the switching mechanism is in the heating operation state.

4. The refrigeration apparatus according to claim 3, further comprising an intercooler switching valve switching between a refrigerant non-return state in which the refrigerant discharged from the first-stage compression element is drawn into the second-stage compression element via the intercooler, and the intercooler and the intake side of the compression mechanism are not connected via the intake return tube, and a refrigerant return state in which the refrigerant discharged from the first-stage compression element is drawn into the second-stage compression element through the intercooler bypass tube, and the intercooler and the intake side of the compression mechanism are connected via the intake return tube.

* * * * *